US010845116B2

(12) United States Patent
Hunter et al.

(10) Patent No.: US 10,845,116 B2
(45) Date of Patent: Nov. 24, 2020

(54) HINGE ASSEMBLY

(71) Applicant: WHIRLPOOL CORPORATION, Benton Harbor, MI (US)

(72) Inventors: Lynne F. Hunter, Dorr, MI (US); Aaron M. Stewart, Buchanan, MI (US); Daniel Lottinville, Howell, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/416,437

(22) Filed: May 20, 2019

(65) Prior Publication Data

US 2019/0285335 A1 Sep. 19, 2019

Related U.S. Application Data

(63) Continuation-in-part of application No. 16/077,807, filed as application No. PCT/US2017/034509 on May 25, 2017.

(Continued)

(51) Int. Cl.
*F25D 23/02* (2006.01)
*E05D 3/16* (2006.01)

(Continued)

(52) U.S. Cl.
CPC ..... *F25D 23/028* (2013.01); *E05D 3/16* (2013.01); *E05D 11/06* (2013.01); *E05D 11/1014* (2013.01); *E05D 15/28* (2013.01); *E05D 2003/166* (2013.01); *E05Y 2201/224* (2013.01); *E05Y 2600/53* (2013.01);

(Continued)

(58) Field of Classification Search
CPC ..... F25D 23/00; F25D 23/02; F25D 23/028; E05D 3/16; E05D 11/06; E05D 11/1014; E05D 15/28
USPC ..... 312/401, 405, 326, 329; 16/366, 368, 16/370, 371
See application file for complete search history.

(56) References Cited

U.S. PATENT DOCUMENTS 2,648,093 A 8/1953 Wilson
2,674,761 A 4/1954 Weiss (Continued)

FOREIGN PATENT DOCUMENTS

DE 3346332 A1 7/1984
DE 4418238 A1 11/1995

(Continued)

*Primary Examiner* — James O Hansen
(74) *Attorney, Agent, or Firm* — Price Heneveld LLP

(57) ABSTRACT

A flush-mount refrigerator is provided that includes a cabinet defining a compartment and including a pair of side walls that extends forwardly of the compartment. A pair of doors is coupled to the cabinet and positioned on either side of a centerline of the cabinet. The pair of doors are spaced apart by a predetermined spacing. A storage feature is positioned within the compartment of the cabinet and movable between an extended position and a recessed position when one or both of the pair of doors is in an open position. A hinge assembly is coupled to the cabinet and to one of the pair of doors. The hinge assembly includes a six-link mechanism that keeps the door within a predefined distance of at least one side wall when the door is moved from a closed position to the open position.

20 Claims, 19 Drawing Sheets

Related U.S. Application Data

(60) Provisional application No. 62/408,984, filed on Oct. 17, 2016.

(51) Int. Cl.
*E05D 15/28* (2006.01)
*E05D 11/10* (2006.01)
*E05D 11/06* (2006.01)

(52) U.S. Cl.
CPC ..... *E05Y 2600/63* (2013.01); *E05Y 2900/31* (2013.01); *F25D 2323/021* (2013.01)

(56) References Cited

U.S. PATENT DOCUMENTS

| | | | | |
|---|---|---|---|---|
| 4,189,805 | A | 2/1980 | Backus | |
| 4,514,021 | A * | 4/1985 | Sundermeier | E05D 3/06 312/291 |
| 5,522,656 | A * | 6/1996 | Jenkins | E05F 1/1246 126/194 |
| 5,931,554 | A | 8/1999 | Koopman | |
| 6,308,376 | B1 | 10/2001 | Koshikawa | |
| 6,568,035 | B2 | 5/2003 | Zetti | |
| 7,406,749 | B2 | 8/2008 | Herper | |
| 7,987,558 | B2 | 8/2011 | Beckmann et al. | |
| 8,307,502 | B2 | 11/2012 | Bonomie et al. | |
| 8,511,768 | B2 | 8/2013 | Brachert | |
| 8,572,808 | B2 | 11/2013 | Bonomie et al. | |
| 9,115,928 | B2 | 8/2015 | Akalan et al. | |
| 9,810,476 | B2 | 11/2017 | Kim et al. | |
| 9,823,011 | B2 | 11/2017 | Kempte | |
| 9,939,192 | B2 | 4/2018 | Yang et al. | |
| 2008/0120807 | A1 | 5/2008 | Heger | |
| 2009/0096333 | A1 * | 4/2009 | Laible | A47B 77/02 312/198 |
| 2010/0231111 | A1 * | 9/2010 | Kang | E05D 3/18 312/405 |
| 2010/0244646 | A1 * | 9/2010 | Laible | E05D 11/0054 312/405 |
| 2012/0080991 | A1 | 4/2012 | Wilson | |
| 2015/0247666 | A1 * | 9/2015 | Kim | F25D 25/00 312/404 |
| 2016/0195325 | A1 * | 7/2016 | Kim | E05D 3/16 312/405 |
| 2018/0187956 | A1 | 7/2018 | Kim et al. | |

FOREIGN PATENT DOCUMENTS

| | | | |
|---|---|---|---|
| DE | 102005004957 | A1 | 8/2006 |
| DE | 102011115930 | A1 | 1/2013 |
| DE | 102005063588 | B3 | 7/2013 |
| EP | 565900 | * | 10/1993 |
| EP | 0628686 | A1 | 12/1994 |
| KR | 2004015030 | A | 12/2004 |
| KR | 102004015030 | A | 12/2014 |

* cited by examiner

HINGE ASSEMBLY

CROSS-REFERENCE TO RELATED APPLICATION

This application is a continuation in part of and claims priority to U.S. patent application Ser. No. 16/077,807, filed Aug. 14, 2018, entitled "HINGE ASSEMBLY" which claims priority to PCT Application No. PCT/US2017/034509, filed May 25, 2017, entitled "HINGE ASSEMBLY", which further claims priority to U.S. Provisional Application No. 62/408,984, filed Oct. 17, 2016, entitled "HINGE ASSEMBLY". The aforementioned related applications are hereby incorporated by reference in its entirety.

FIELD OF THE INVENTION

The present disclosure generally relates to a hinge assembly, and more specifically to a six-link hinge assembly for a refrigerator.

BACKGROUND

Hinges having a single pivot point are commonly used for a coupling a door to an appliance. In some circumstances, however, it is desired to utilize multi-pivot-point hinges that allow full accessibility to a compartment of the appliance.

BRIEF SUMMARY OF THE DISCLOSURE

According to one aspect of the disclosure, a flush-mount refrigerator is disclosed. The refrigerator includes a cabinet defining a compartment. The cabinet is framed by cabinetry. A door is configured to seal the compartment and is operable between open and closed positions. The door is a predetermined distance from the cabinetry when the door is in the open position. A storage feature is positioned within the compartment and may be movable between an extended position and a recessed position when the door is in the open position. A hinge assembly is operably coupled to the cabinet and to the door. The hinge assembly includes a first link coupled to the cabinet. A second link is pivotable about the first link. A third link is pivotable about the second link. The third link includes a vertical surface. A fourth link is coupled to the door. The third link is pivotable about the fourth link. An edge of the fourth link may be configured to contact the vertical surface of the third link when the door is in the open position. A fifth link is pivotable about the second link and the fourth link. A sixth link is pivotable about an intermediate portion of the fifth link and the first link. The sixth link is disposed through a void defined by the fifth link.

According to another aspect of the present disclosure, a refrigerator is disclosed. The refrigerator includes a cabinet defining a compartment and having at least one side wall. The cabinet is framed by cabinetry. A first door and a second door are coupled with the cabinet and are movable between an open position and closed position. A front surface of each of the first and second doors is substantially coplanar with a front surface of the cabinetry when each of the first and second doors is in the closed position. Each of the first and second doors are configured to remain positioned on a respective side of a centerline of the cabinet. A hinge assembly is coupled to the cabinet and to one of the first and second doors. The hinge assembly includes a six-link mechanism that translates and rotates the respective door forwardly and outwardly of at least one side wall when the respective door is moved from a closed position to the open position. The hinge is configured to rotate the respective door along until the door is at a predetermined angle relative to a front of the cabinet. The predetermined angle measures greater than 90 degrees.

According to yet another aspect of the present disclosure, a flush-mount refrigerator is disclosed. The refrigerator includes a cabinet defining a compartment and including a pair of side walls that extends forwardly of the compartment. A pair of doors is coupled to the cabinet. Each of the pair of doors is positioned on either side of a centerline of the cabinet. The pair of doors are spaced apart by a predetermined spacing. A storage feature is positioned within the compartment of the cabinet and is movable between an extended position and a recessed position when one or both of the pair of doors is in an open position. A hinge assembly is coupled to the cabinet and to one of the pair of doors. The hinge assembly includes a six-link mechanism that keeps the door within a predefined distance of at least one side wall when the door is moved from a closed position to the open position.

These and other features, advantages, and objects of the present disclosure will be further understood and appreciated by those skilled in the art by reference to the following specification, claims, and appended drawings.

BRIEF DESCRIPTION OF THE DRAWINGS

The foregoing summary, as well as the following detailed description of the disclosure, will be better understood when read in conjunction with the appended drawings. For the purpose of illustrating the disclosure, certain examples are shown in the drawings. It should be understood, however, that the disclosure is not limited to the precise arrangements and instrumentalities shown. Drawings are not necessarily to scale. Certain features of the disclosure may be exaggerated in scale or shown in schematic form in the interest of clarity and conciseness.

DETAILED DESCRIPTION

As required, detailed examples of the present disclosure are disclosed herein. However, it is to be understood that the disclosed examples are merely exemplary of the disclosure that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present disclosure.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

It is to be understood that the present disclosure is not limited to the particular examples described below, as variations of the particular examples may be made and still fall within the scope of the appended claims. It is also to be understood that the terminology employed is for the purpose of describing particular examples, and is not intended to be limiting. Instead, the scope of the present disclosure will be established by the appended claims.

Figure 1:
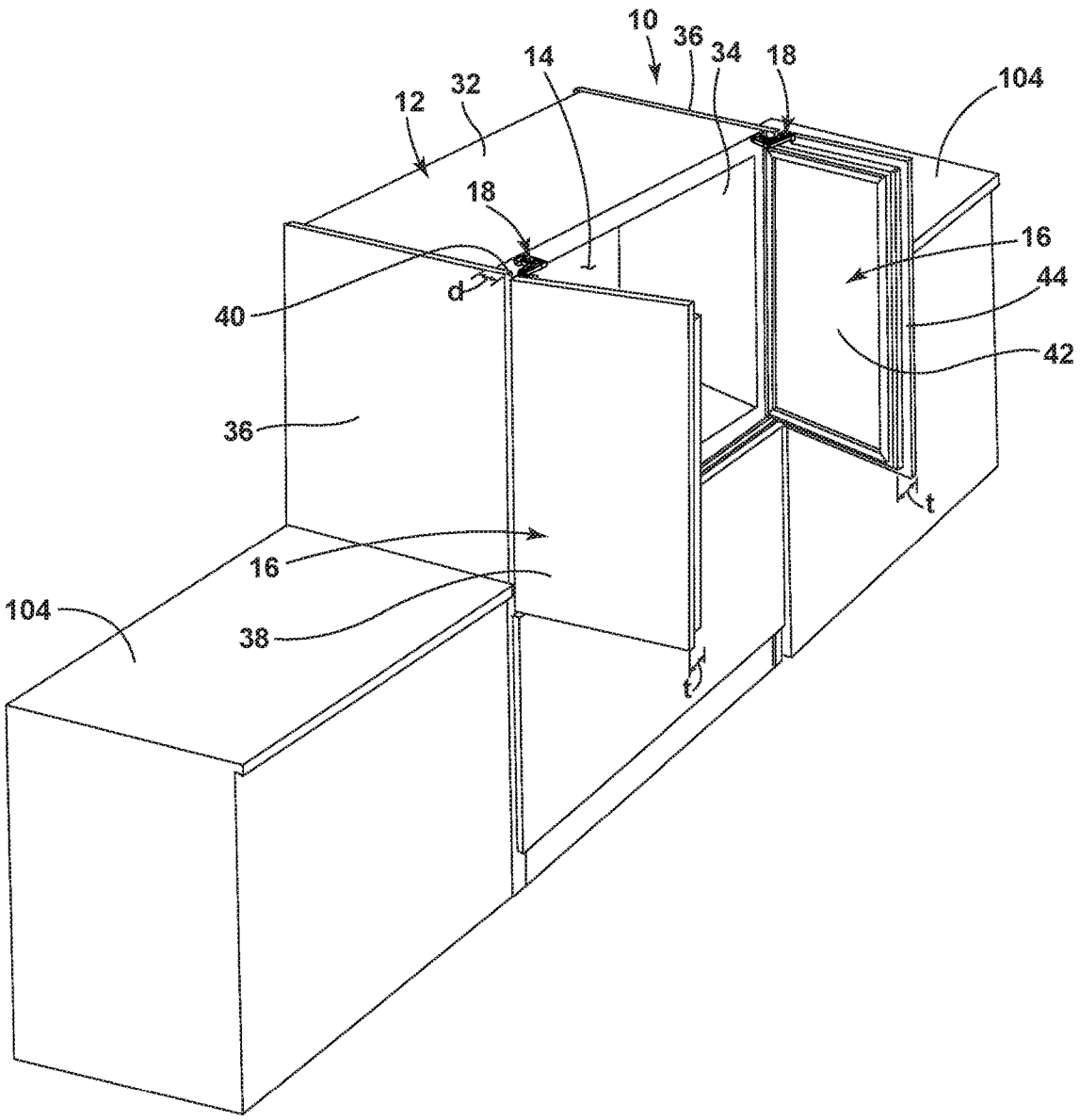
FIG. 1 is a top perspective view of a refrigerator having a hinge assembly coupling a door to a cabinet, according to some examples.

For purposes of description herein, the terms "upper," "lower," "right," "left," "rear," "front," "vertical," "horizontal," and derivatives thereof shall relate to the disclosure as oriented in FIG. 1, unless stated otherwise. However, it is to be understood that the disclosure may assume various alternative orientations, except where expressly specified to the contrary. It is also to be understood that the specific devices and processes illustrated in the attached drawings, and described in the following specification, are simply exemplary examples of the inventive concepts defined in the appended claims. Hence, specific dimensions and other physical characteristics relating to the examples disclosed herein are not to be considered as limiting, unless the claims expressly state otherwise.

Referring to FIGS. 1-11, a refrigerator 10 includes a cabinet defining a compartment 14. A door 16 is configured to seal the compartment 14 and is operable between open and closed positions. A hinge assembly 18 is operably coupled to the cabinet 12 and to the door 16. The hinge assembly 18 includes a first link 20 coupled to the cabinet 12. A second link 22 is pivotable about the first link 20. A third link 24 is pivotable about the second link 22 and a fourth link 26. The fourth link 26 is further coupled to the door 16. A fifth link 28 is pivotable about the second link 22 and the fourth link 26. A sixth link 30 is pivotable about an intermediate portion of the fifth link 28 and the first link 20. The sixth link 30 is disposed through a void 144 defined by the fifth link 28.

Referring now to FIG. 1, the cabinet 12 is formed from a wrapper 32 and a liner 34 and defines one or more compartments 14. The one or more compartments 14 may be configured as a fresh food compartment, a freezer compartment, and/or any other desired compartment known in the art. The refrigerator 10 also includes a refrigeration system (not shown). The refrigeration system includes various components for generating chilled air within the one or more compartments 14, as will be understood by those skilled in the art. It will be appreciated that the one or more compartments 14 may have any suitable arrangement without departing from the scope of the present disclosure.

The door 16 may include an inner door panel 42 and an outer door panel 44. The outer door panel 44 may be a decorative door panel, such as a metal or wood door panel, which is attached by any suitable means to the inner door panel 42. The inner door panel 42 may be constructed of any suitable material, such as an inner plastic liner, and may cooperate with the cabinet 12 when the door 16 is closed in order to seal the one or more compartments 14.

The hinge assembly 18 is operably coupled to the cabinet 12 and to the door 16. The hinge assembly 18 is configured to move the door 16 between the open and the closed positions to provide access to the one or more compartments 14. As will be discussed in greater detail below, the hinge assembly 18 may be configured to rotate the door 16 relative to the cabinet 12 and/or translate the door 16 towards and away from the cabinet 12 when the door 16 is moved between the open and closed positions.

With further reference to FIG. 1, the wrapper 32 includes a pair of side walls 36 that may extend beyond the one or more compartments 14. The pair of side walls 36 may extend a distance d forwardly of the one or more compartments 14. Likewise, the door 16 has a thickness t causing a front surface 38 of the door 16 to extend forwardly of the one or more compartments 14 when the door 16 is in the closed position. In some examples, the distance d of the side wall 36 extension and the thickness t of the door 16 may be substantially equal such that a front surface 40 of the side wall 36 and the front surface 38 of the door 16 may substantially align when the door 16 is in the closed position. Accordingly, in some examples, the refrigerator 10 may be configured as a "flush-mounted refrigerator" because a front of the refrigerator 10 lies substantially aligned, or substantially flush, with a front of adjacent cabinetry 104, as is understood by those skilled in the art. For purposes of the present disclosure, "substantially aligned" and "substantially flush" mean that a surface of the door 16 and a surface of the cabinet 12 extend in a generally common direction. It will be understood that the door 16 and/or the cabinet 12 may be offset from one another in a non-aligned manner and that such assemblies may still be considered to be "substantially aligned" or "substantially flush" in accordance with the present disclosure. For example, the door 16 may be offset from any surface of the cabinet 12 by any predefined distance (e.g., 200 mm or less) and still be considered "substantially aligned" or "substantially flush."

It will be understood that the refrigerator 10 may take a variety of configurations, including French door, side-byside, top freezer, bottom freezer, counter depth, compact, built-in, and/or other types of refrigerators 10. The door 16 may be either a refrigerator door or a freezer door. Although the hinge assembly 18 is depicted as positioned on right and left sides of the refrigerator 10, the hinge assembly 18 may be used on any other location (top, center, bottom, or sides). In various examples, portions of the hinge assembly 18 may be hidden or concealed using a cover, which may create an aesthetically pleasing hinge assembly 18.

Figure 2:
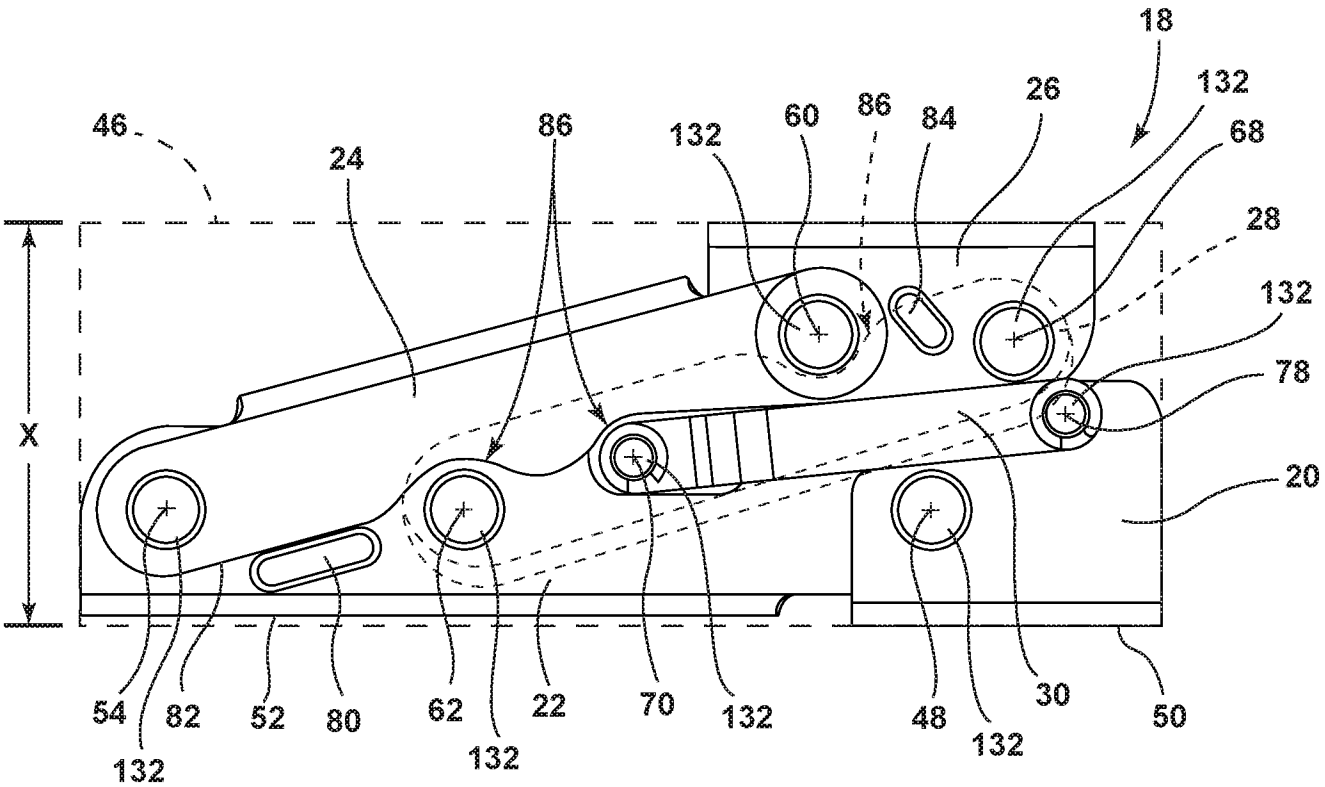
FIG. 2 is a top plan view of the hinge assembly in the contracted position, according to some examples.
Figure 3:
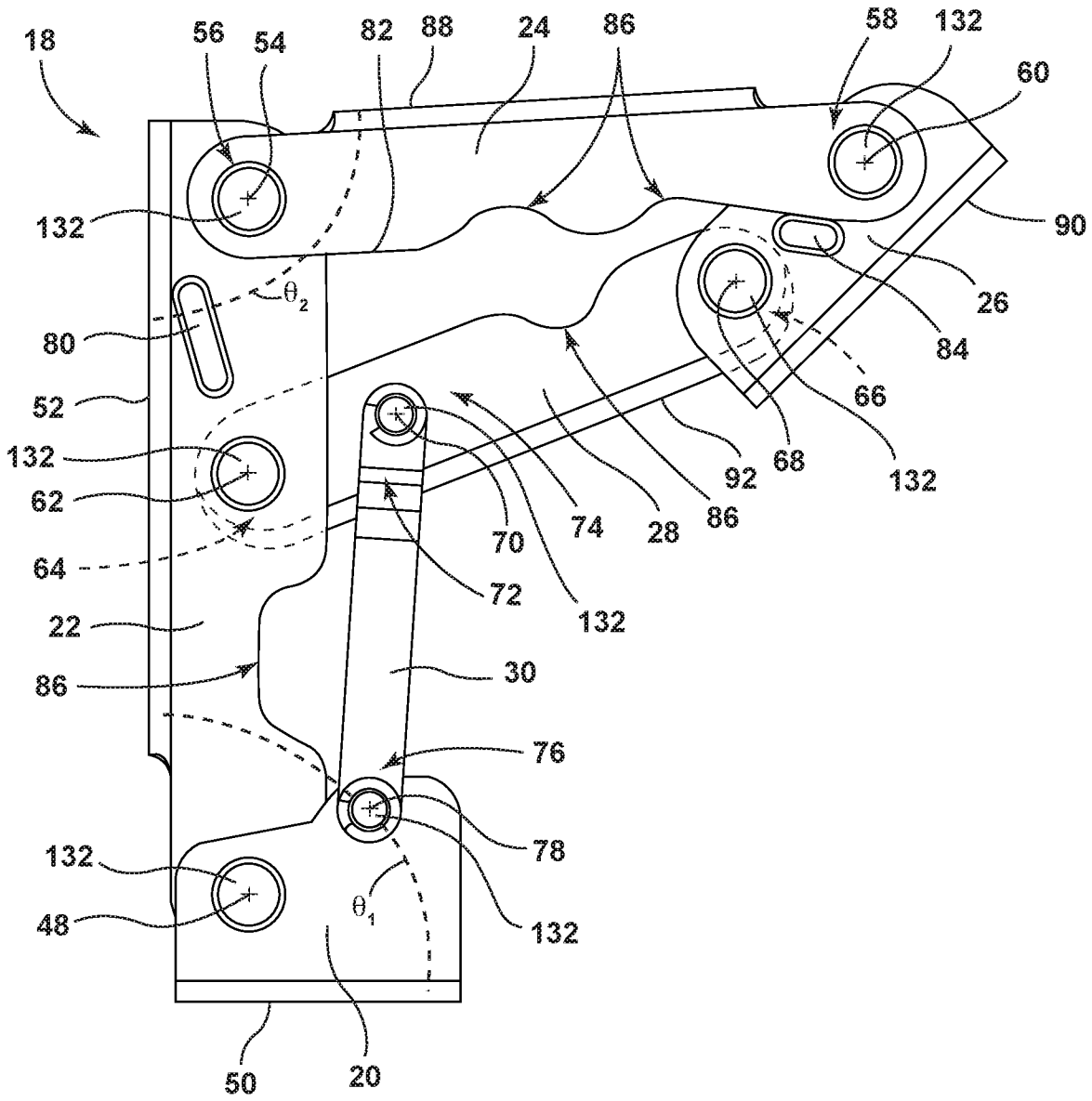
FIG. 3 is a top plan view of the hinge assembly in the expanded position, according to some examples.

Referring to FIGS. 2 and 3, the hinge assembly 18 is illustrated in a contracted position (FIG. 2) and an expanded position (FIG. 3). When the refrigerator 10 is assembled, the contracted position places the door 16 in the closed position. The expanded position places the door 16 in the open position. The hinge assembly 18 may also be placed in a plurality of intermediate positions between the contracted and expanded positions. A contracted position envelope 46 is defined by a packaging space for placement of the hinge assembly 18 in the contracted position and may be disposed in a position that is forward of the compartment 14. Accordingly, in some examples, the hinge assembly 18 may be coupled to an outer and/or front surface of the cabinet 12. The contracted position envelope 46 has a thickness x that may be less than the thickness t of the door 16. Accordingly, the hinge assembly 18 may be concealed when the door 16 is in the closed position. The thickness x of the contracted position envelope 46 may also be less than the side wall 36 extension distance d.

Referring to FIGS. 2 and 3, the hinge assembly 18 may be configured as a six-link mechanism. For example, according to some examples, the hinge assembly 18 may include a Watt's six-link mechanism for movement. The selection of a Watt's six-link mechanism allows for a wide-open position and/or a large range of motion, although other link isomers and isomer variations may be selected without departing from the scope of the present disclosure.

Figure 5:
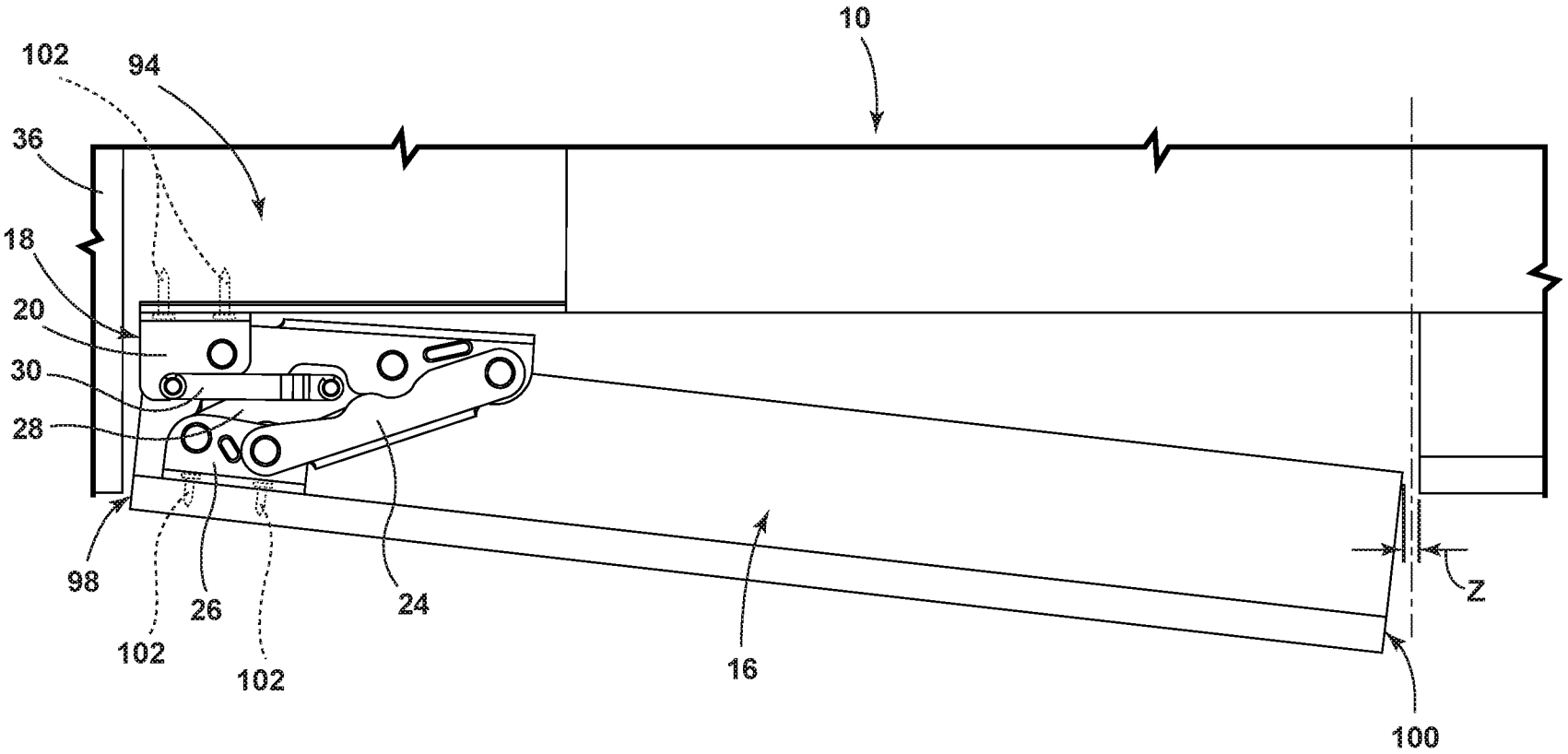
FIG. 5 is a partial top plan view of the refrigerator with the door in a first intermediate position.
Figure 6:
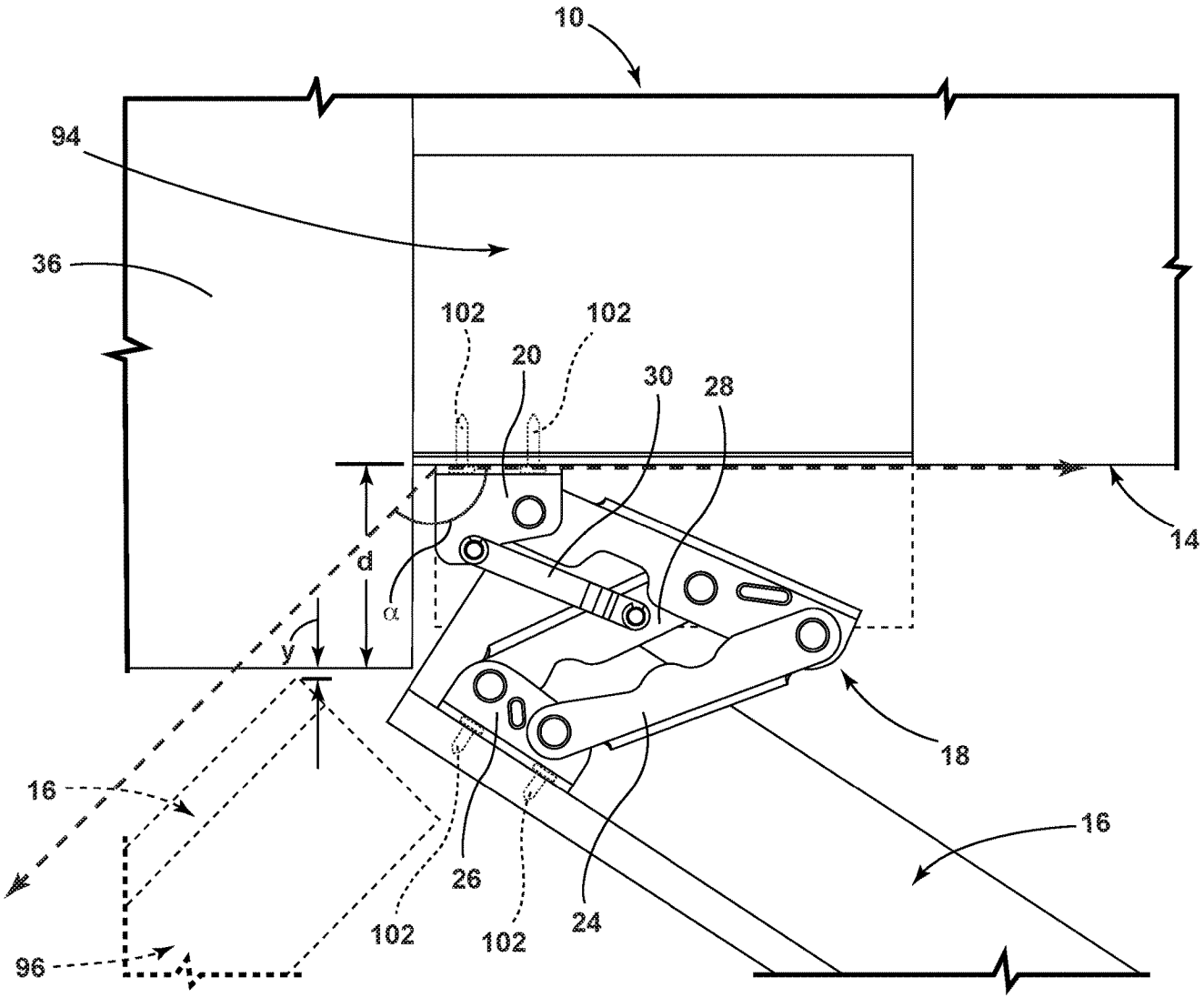
FIG. 6 is a partial top plan view of the refrigerator with the door in a second intermediate position and an open position.

The six links 20, 22, 24, 26, 28, 30 of the hinge assembly 18 define seven pivot points 48, 54, 60, 62, 68, 70, 78. The first link 20 is configured as a bracket that is coupled to the cabinet 12 through any means known in the art, such as, but not limited to, mechanical fasteners 102 (FIG. 5). The second link 22 pivots about the first link 20 at a first pivot point 48, which may include a pivotable member 132, such as a pin, a rivet, a pivot rod 106 (FIG. 7) and/or any other pivot device known in the art. The second link 22 may extend along a surface of the cabinet 12 when the hinge assembly 18 is in the contracted position. Accordingly, a rear surface, or vertical surface, 50 of the first link 20 and a rear surface, or vertical surface, 52 of the second link 22 may be coplanar and/or parallel in the contracted position.

The third link 24 pivots about the second link 22 at a second pivot point 54 at a first end portion 56 of the third link 24. At an opposing second end portion 58 of the third link 24, the third link 24 pivots about the fourth link 26 at a third pivot point 60. Likewise, the fifth link 28 also pivots about the second link 22 at a fourth pivot point 62 at a first end portion 64 of the fifth link 28. At an opposing second end portion 66, the fifth link 28 pivots about the fourth link 26 at a fifth pivot point 68.

The sixth link 30 pivots about the fifth link 28 at sixth pivot point 70 at one end portion 72 of the sixth link 30. The sixth pivot point 70 may be disposed on an intermediate portion 74 of the fifth link 28 between the fourth and fifth pivot points 62, 68. The sixth link 30 further pivots about the first link 20 on a second end portion 76 about a seventh pivot point 78 thereby completing the six-link mechanism. In some examples, the second pivot point 54 and the fourth pivot point 62 may be further in distance from one another than the third pivot point 60 to the fifth pivot point 68. According to some examples, the hinge assembly 18 may be positioned above a top surface of the cabinet 12. The first link 20 may extend along the cabinet 12 of the refrigerator 10. The second link 22 may extend orthogonally from the first link 20 in the open position.

With further reference to FIGS. 2 and 3, a first stop 80 is integrally formed, or otherwise disposed, on the second link 22 and may be configured as a raised portion, or any other stop known in the art. When the hinge assembly 18 is disposed in the contracted position, an interior surface 82 of the third link 24 may contact the first stop 80. Similarly, a second stop 84 may be disposed on the fourth link 26 that contacts the interior surface 82 of third link 24 in the open position.

With further reference to FIGS. 2 and 3, any of the links 20,22, 24, 26, 28, 30 may define a relief 86 thereon. For example, the second, third and fifth links 22, 24, 28 may define one or more reliefs 86 thereon. The reliefs 86 may be configured as an indentation, a notch, an aperture, and/or any other feature on any of the links 20, 22, 24, 26, 28, 30. The reliefs 86 may each be configured to allow the hinge assembly 18 to compactly dispose some links 20, 22, 24, 26, 28, 30 over others when the hinge assembly 18 is in the contracted position to reduce the contracted position envelope 46 (packaging space) of the hinge assembly 18.

According to some examples, each link 20, 22, 24, 26, 28, 30 is formed by a stamping operation and subsequently coupled to one another 20, 22, 24, 26, 28, 30 at the pivot points 48, 54, 60, 62, 68, 70, 78. A die may be used to cut the links 20, 22, 24, 26, 28, 30 from stock material and form any desired features, such as stops 80, 84 and/or reliefs 86. A plurality of links 20, 22, 24, 26, 28 may include vertical surfaces 50, 52, 88, 90, 92 that transversely extend from a top surface 108, 110, 112, 114, 116 (FIG. 7) of each respective link 20, 22, 24, 26, 28. The transversely, vertically extending surfaces 50, 52, 88, 90, 92 may be disposed around a perimeter of the hinge assembly 18 and also formed by the die and/or any other bending and/or forming process.

Referring still to FIGS. 2 and 3, when the hinge assembly 18 is in the contracted position, as illustrated in FIG. 2, the first and second links 20, 22 extend in a substantially common direction. As the hinge assembly 18 is moved to the expanded position, as illustrated in FIG. 3, a change in angle $\theta_1$, which may be defined by the relationship between the first and second pivot points 48, 54, may be greater than sixty (60) degrees. In some examples, the change in angle $\theta_1$ may be ninety (90) degrees or greater. Likewise, in some examples, when the hinge assembly 18 is in the expanded position, an angle $\theta_2$ between the second and third links 22, 24 may be about seventy (70) degrees or more. Further, the fifth link 28 may be transverse to the third and/or fourth links 24, 26 in the open position. Accordingly, in the open position, the second and fifth links 22, 28 may be substantially parallel. Additionally, the third link 24, the fourth link 26, and/or the adjacent cabinet may be substantially aligned when the hinge is in the open position.

Figure 4:
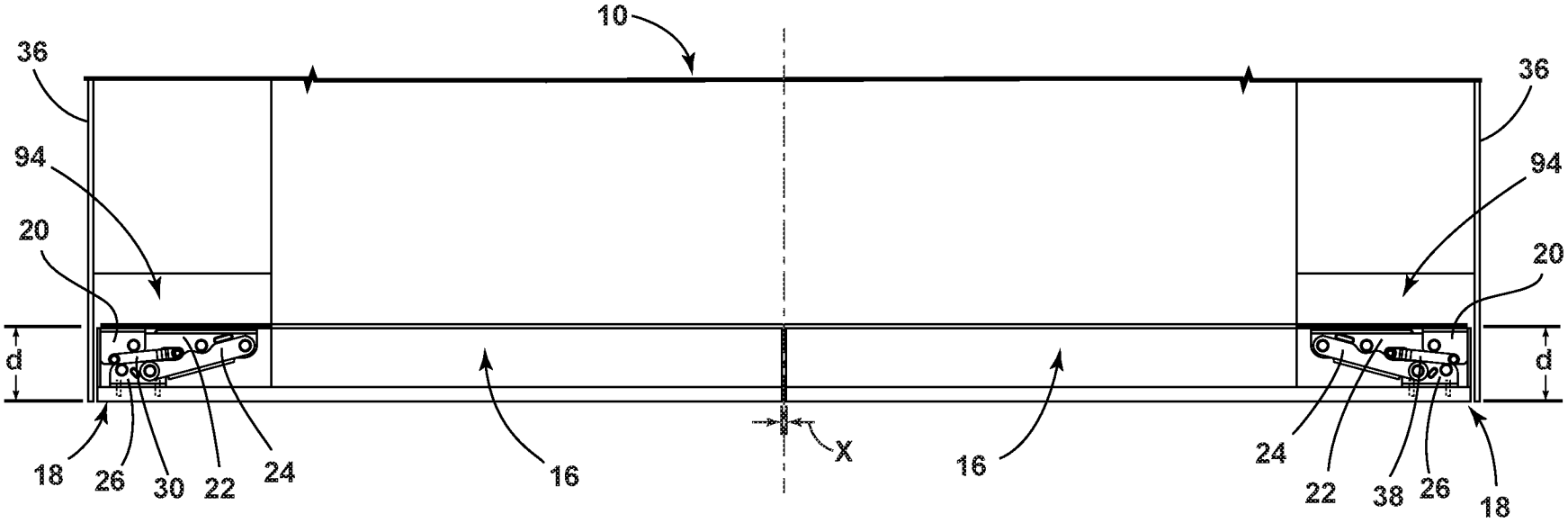
FIG. 4 is a top plan view of the refrigerator having a pair of doors each in a closed position.

Referring to FIGS. 4 and 5, a top bracket 94 is disposed on the cabinet 12 and configured to couple to the hinge assembly 18. As the door 16 is opened, the door 16 translates and rotates so that the door 16 is displaced forwardly of the side wall 36 and/or the opposing door 16. As the door 16 approaches the open position, the door 16 may be disposed in a position 96 (FIG. 6) outwardly of the compartment 14 thereby allowing access to a substantial amount of the compartment 14.

Figure 7:
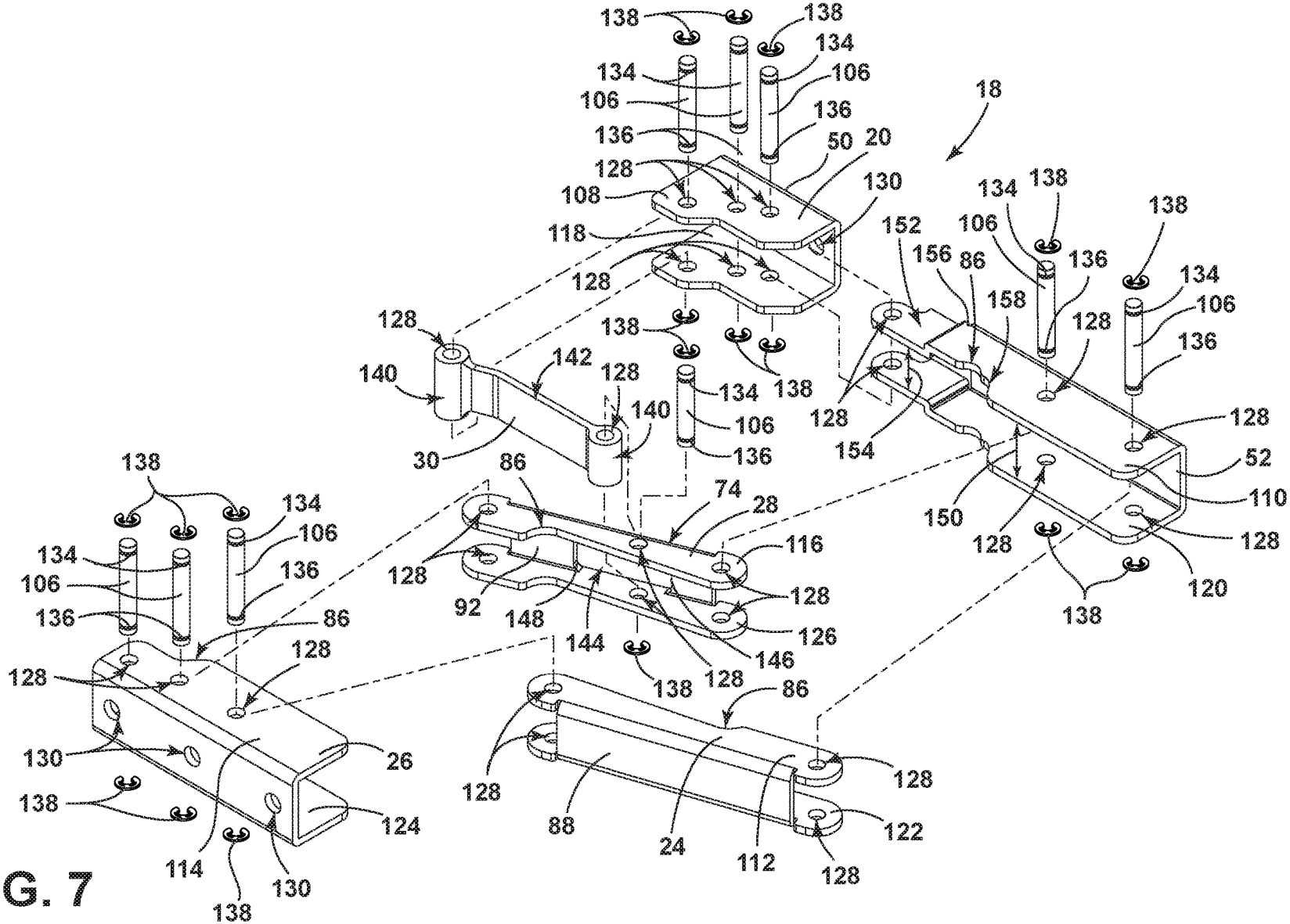
FIG. 7 is an exemplary exploded perspective view of the hinge assembly.

Referring to FIG. 7, as provided herein, any of the links may include a first, possibly horizontally extending surfaces 108, 110, 112, 114, 116 and a second, vertically extending surfaces 50, 52, 88, 90, 92. A second set of surfaces 118, 120, 122, 124, 126, which may be horizontally orientated, may extend from the opposing end of the vertical surface 50, 52, 88, 90, 92 forming one or more "C-shaped" links. According to some examples, the first surfaces 108, 110, 112, 114, 116 may be substantially parallel with the second surfaces 118, 120, 122, 124, 126.

Any surface of the links 20, 22, 24, 26, 28, 30 may define one or more pivot openings 128 and/or fastener openings 130. For example, in the illustrated example, the first member defines three pivot openings 128 in each of the first and second surfaces 108, 118. The three pivot point openings may be vertically aligned such that the pivotable member 132 may be disposed within each respective pair of pivot openings 128. The fastener openings 130 may be configured to have the fastener 102 disposed therethrough for coupling the bracket to an additional surface, such as the cabinet 12 and/or the door 16.

Referring still to FIG. 7, the pivotable members 132 that couple each link to the remaining respective links may be configured as pivot rods 106, although any other fastener may be utilized without departing from the scope of the present disclosure. Each pivot rod 106 may define an upper rim 134 and a lower rim 136. The upper and lower rims 134, 136 may have a smaller circumference than the remaining portions of the pivot rod 106. A clip 138 may be slid into each respective rim by elastically deforming the clip 138. Once the clip 138 is slid into the upper rim 134 and/or the lower rim 136, the clip 138 may return to its original shape and may be removably coupled to the pivot rod 106. The clip 138 has an outer circumference that is larger than the circumference of the pivot opening 128. Accordingly, the pivot rod 106 may be held in place within the pivot opening 128.

With further reference to FIG. 7, the sixth link 30 may include two opposing attachment structures 140 and an elongated, vertically extending body portion 142. According to various examples, the body portion 142 may be substantially parallel in orientation to the vertical surface 50 of the first link 20. The body portion 142 may also be non-linear. In some examples, the vertical orientation of the sixth link 30 may provide support for the hinge assembly 18, and the door 16, when the hinge assembly 18 is disposed in the open position in a vertical direction.

Like the first link 20, the fifth link 28 may include substantially parallel surfaces 116, 126 that are each coupled to a vertically extending surface 92. The vertical surface 92 of the fifth link 28 may define a void 144 therein. The body 142 of the sixth link 30 may extend through the void 144. As the hinge assembly 18 is rotated through a plurality of positions, the sixth link 30 rotates within the void 144. Accordingly, the void 144 may be configured to have a width that accounts for the full range of motion of the hinge assembly 18. In other words, a first side 146 of the void 144 may be disposed laterally outward of the sixth link 30 when the hinge assembly 18 is in the contracted position. A second, opposing side 148 of the void 144 may be laterally outward of the sixth link 30 when the hinge assembly 18 is in the open position.

Figure 8:
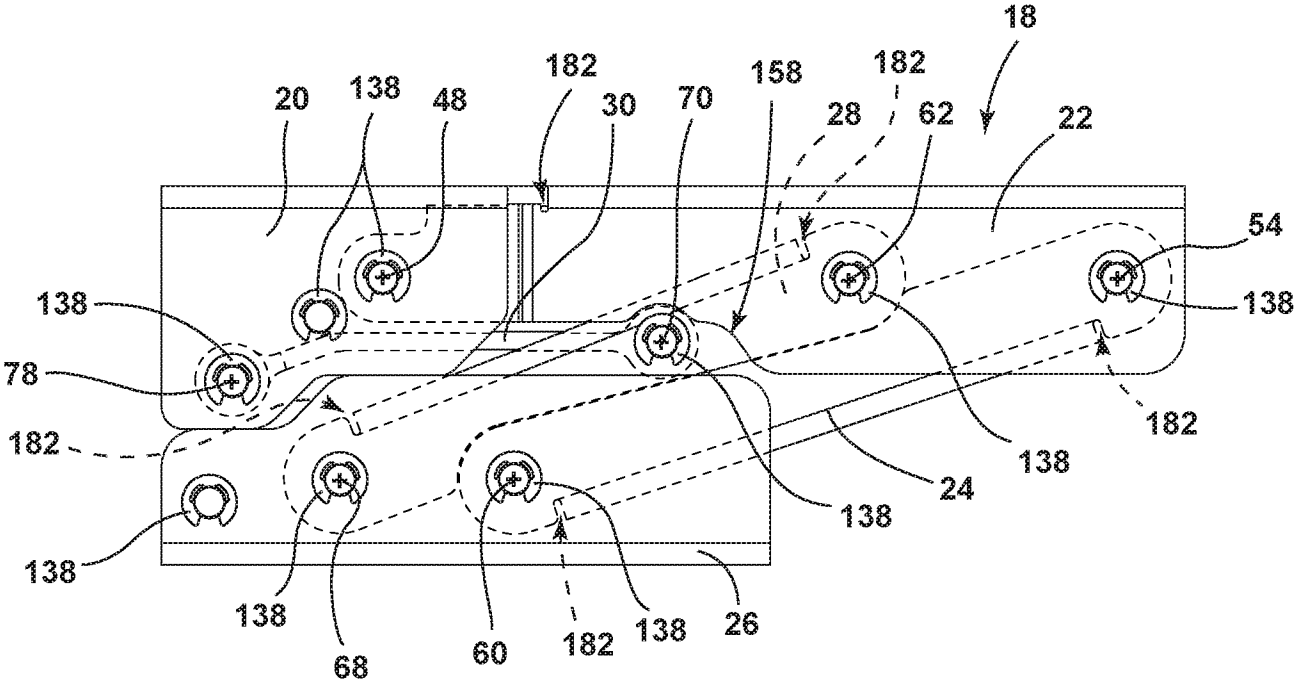
FIG. 8 is a top plan view of the hinge assembly in the contracted position, according to some examples, having at least one link in a vertical orientation.
Figure 9:
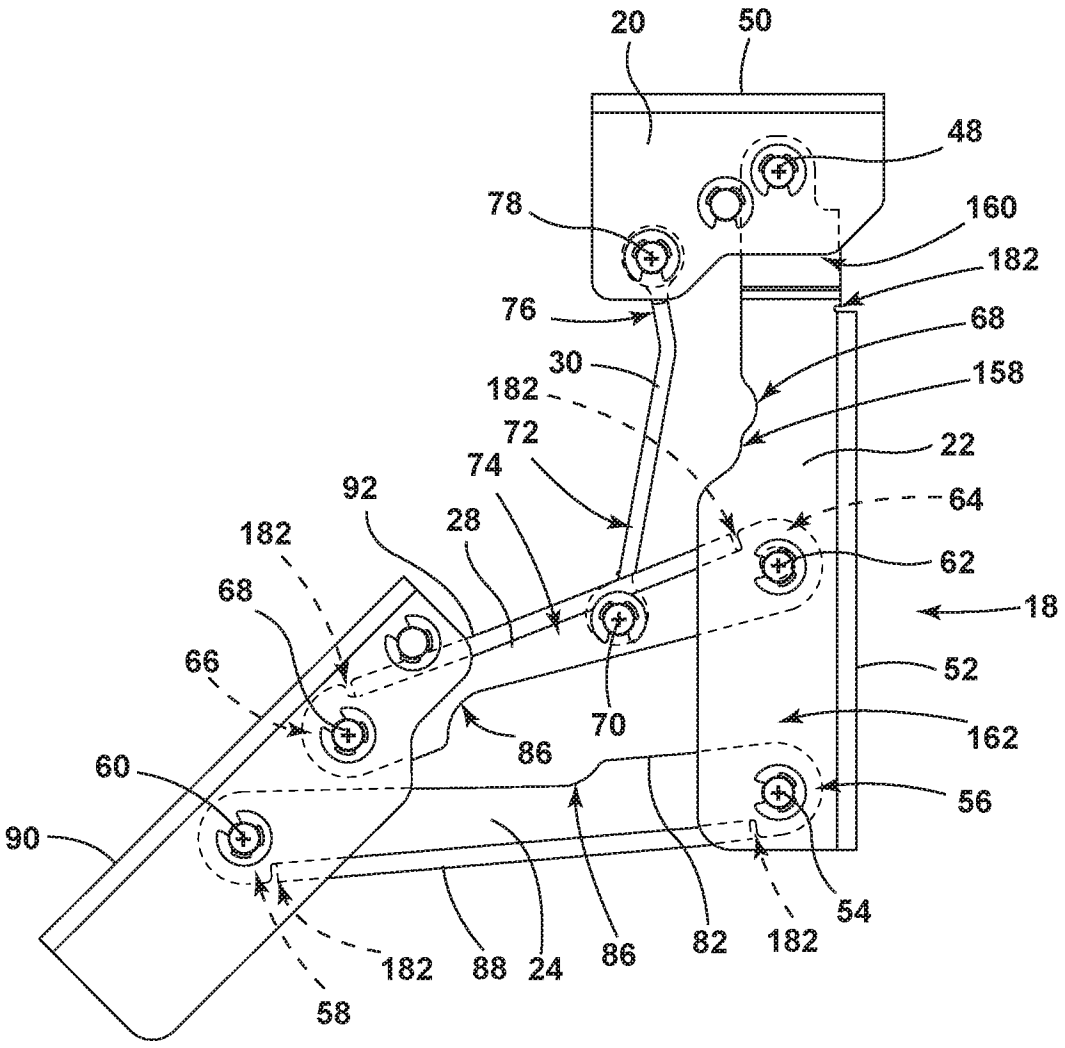
FIG. 9 is a top plan view of the hinge assembly in the expanded position, according to some examples.

Referring still to FIGS. 7-9, the second link 22, like the first link 20, may include a pair of surfaces 110, 120 that extend in a substantially parallel direction with a perpendicular second surface 52 disposed therebetween. The pair of surfaces 110, 120 of the second link 22 is separated by a first distance 150. The second link 22 may also include a coupling portion 152 that is to be disposed between the pair of horizontal surfaces 108, 118 of the first link 20. The surfaces 110, 120 of the second link 22 within the coupling portion 152 may be separated by a second, smaller distance 154 from one another. Accordingly, the coupling portion 152 may be partially disposed within the first link 20. The coupling portion 152 of the second link 22 may provide clearance between the first link 20 and an end portion 156 of the coupling portion 152 as one link 20, 22 rotates about the other link 20, 22 between the contracted and open positions.

The second link 22 may include a first portion 160 that is engageable with the first link 20 and a second portion 162 engageable with the third and fifth links 24, 28. A transition portion 158 may be disposed between the first and second portions 160, 162. The transition portion 158 is configured to increase the width of the pair of surfaces 110, 120 of the second link 22. The transition portion 158 may also include the relief 86 thereon.

Referring still to FIGS. 7-9, some of the links (e.g., the second link 22, the third link 24, and the fifth link 28) may include vertical surfaces 52, 88, 92 that extend less than the full length of the link 22, 24, 28. Accordingly, an indent 182 may be disposed outwardly of each end of the vertical sections. The indent 182 may be cut into the link 22, 24, 28 prior to bending of the vertical surfaces 52, 88, 92.

Figure 10:
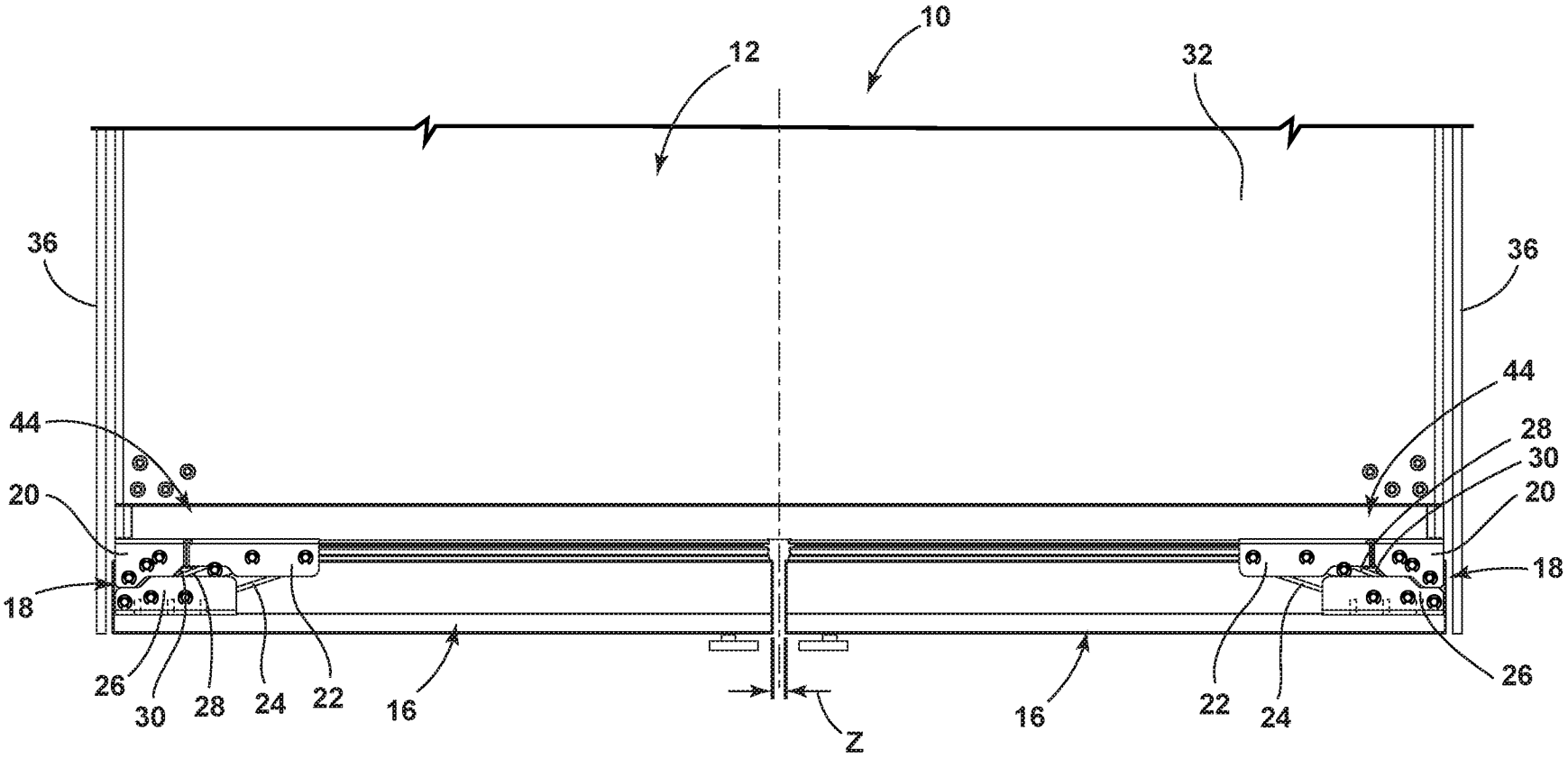
FIG. 10 is a top plan view of the refrigerator having the pair of doors each in a closed position.
Figure 11:
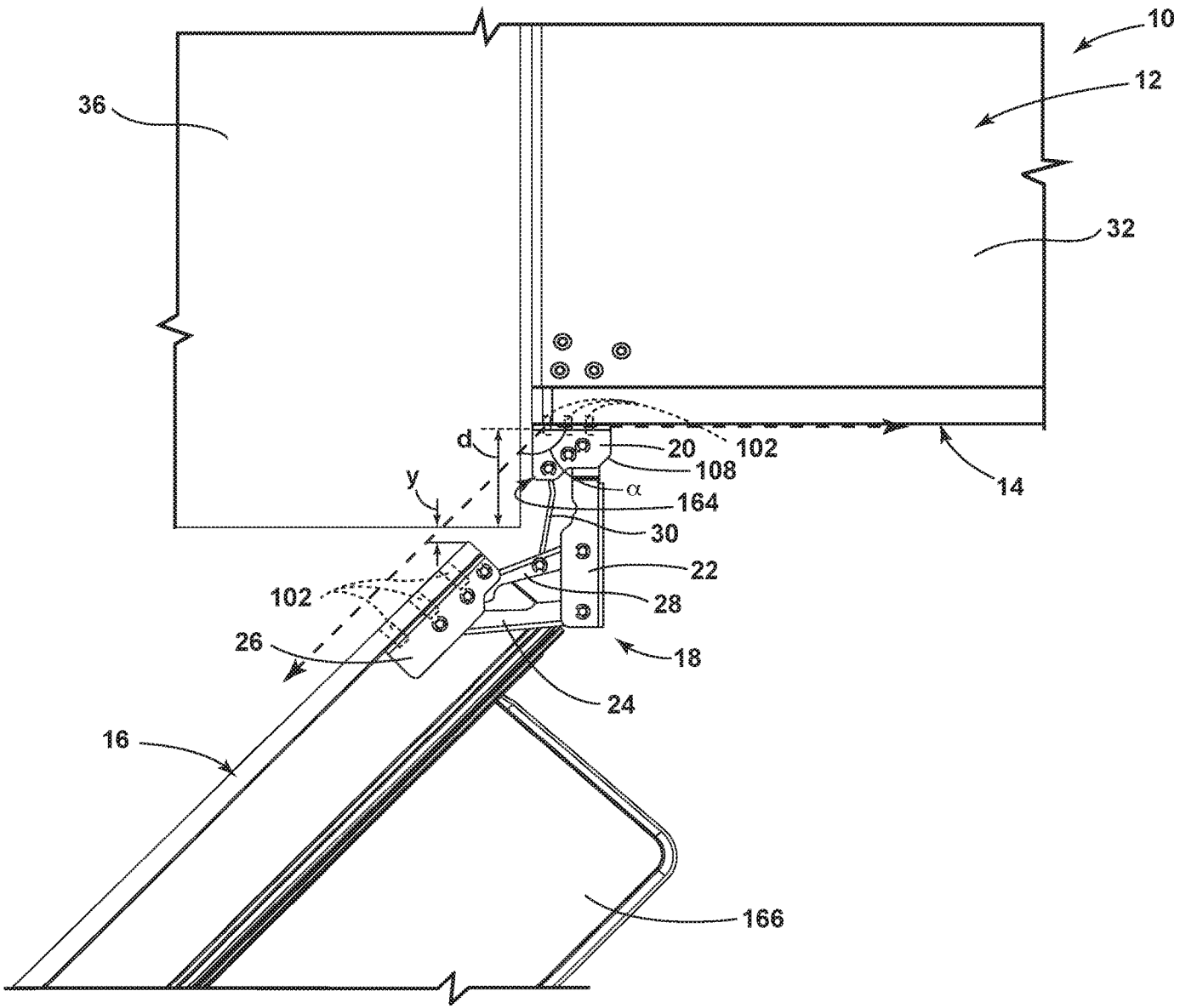
FIG. 11 is a partial top plan view of the refrigerator with the door in an open position, according to some examples.

Referring to FIGS. 10 and 11, as the door 16 moves from a closed position, as illustrated in FIG. 10, to an open position, as illustrated in FIG. 11, the hinge may rotate and/or translates the door 16 laterally outward of the cabinet 12. Accordingly, a bin within the cabinet 12 may be removable without contact with the door 16. Moreover, the sixth link 30, which may have a non-linear orientation, may extend from a position laterally inward of the cabinet 12 to a position laterally outward of the cabinet 12. The sixth link 30 may be connected to a protruding portion 164 of the first link 20 that extends further from the cabinet 12 than the remaining portions of the top surface 108 of the first link 20.

Since the hinge assembly 18 may translate and/or rotate, the door 16 may have a consistent movement distance between opposing sides 98, 100 (FIG. 5) of the door 16. In other words, a small increment in the opening motion of the door 16 induces a corresponding increase in door angle that has an increased perceived value when compared to a pivot point hinge. With a pivot point hinge, a short increment in the opening motion induces a large increment in door angle movement that may feel unnatural or of low perceived value to customers.

Figure 12:
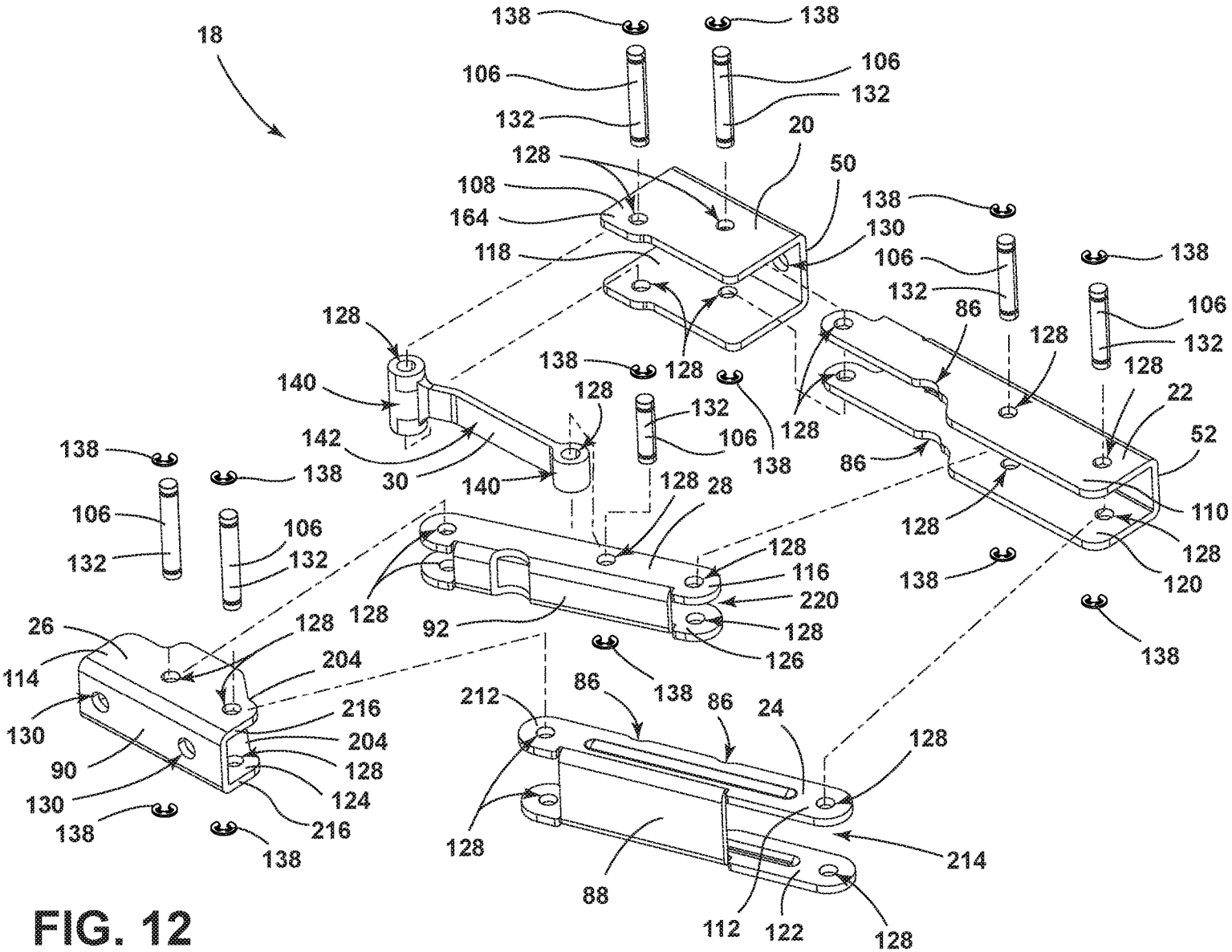
FIG. 12 is an exemplary exploded perspective view of the hinge assembly, according to some examples.

Referring now to FIGS. 12-18, the hinge assembly 18 is shown having an integral stop formed by the vertical surface 88 of the third link 24. As shown in FIG. 12, and as discussed elsewhere herein, any of the links 20, 22, 24, 26, 28, 30 may include a first, possibly horizontally extending surface 108, 110, 112, 114, 116 and a second, vertically extending surfaces 50, 52, 88, 90, 92. A second set of surfaces 118, 120, 122, 124, 126, which may be horizontally orientated, may extend from the opposing end of the vertical surface 50, 52, 88, 90, 92 forming one or more "C-shaped" links. According to some examples, the first surfaces 108, 110, 112, 114, 116 may be substantially parallel with the second surfaces 118, 120, 122, 124, 126.

Any surface of the links 20, 22, 24, 26, 28, 30 may define one or more pivot openings 128 and/or fastener openings 130. For example, in the illustrated example, the first member defines two pivot openings 128 in each of the first and second surfaces 108, 118. The pivot point openings 128 of the first and second surface 108, 118 may be vertically aligned such that the pivotable member 132 may be disposed within each respective pair of pivot openings 128. The fastener openings 130 may be configured to have a fastener disposed therethrough for coupling the first link 20 to an additional surface, such as the cabinet 12 and/or the door 16 (see FIGS. 15 and 16).

Referring still to FIG. 12, the pivotable members 132 that couple each link to the remaining respective links may be configured as pivot rods 106, although any other fastener may be utilized without departing from the scope of the present disclosure. The pivot rod 106 may be held in place within the pivot opening 128 by pivot clips 138, as discussed elsewhere herein.

With further reference to FIG. 12, the sixth link 30 may include two opposing attachment structures 140 and an elongated, vertically extending body portion 142. According to various examples, the body portion 142 may be substantially parallel in orientation to the vertical surface 50 of the first link 20. The body portion 142 may also be non-linear. In some examples, the vertical orientation of the sixth link 30 may provide support for the hinge assembly 18, and the door 16, when the hinge assembly 18 is disposed in the open position in a vertical direction.

Figure 13:
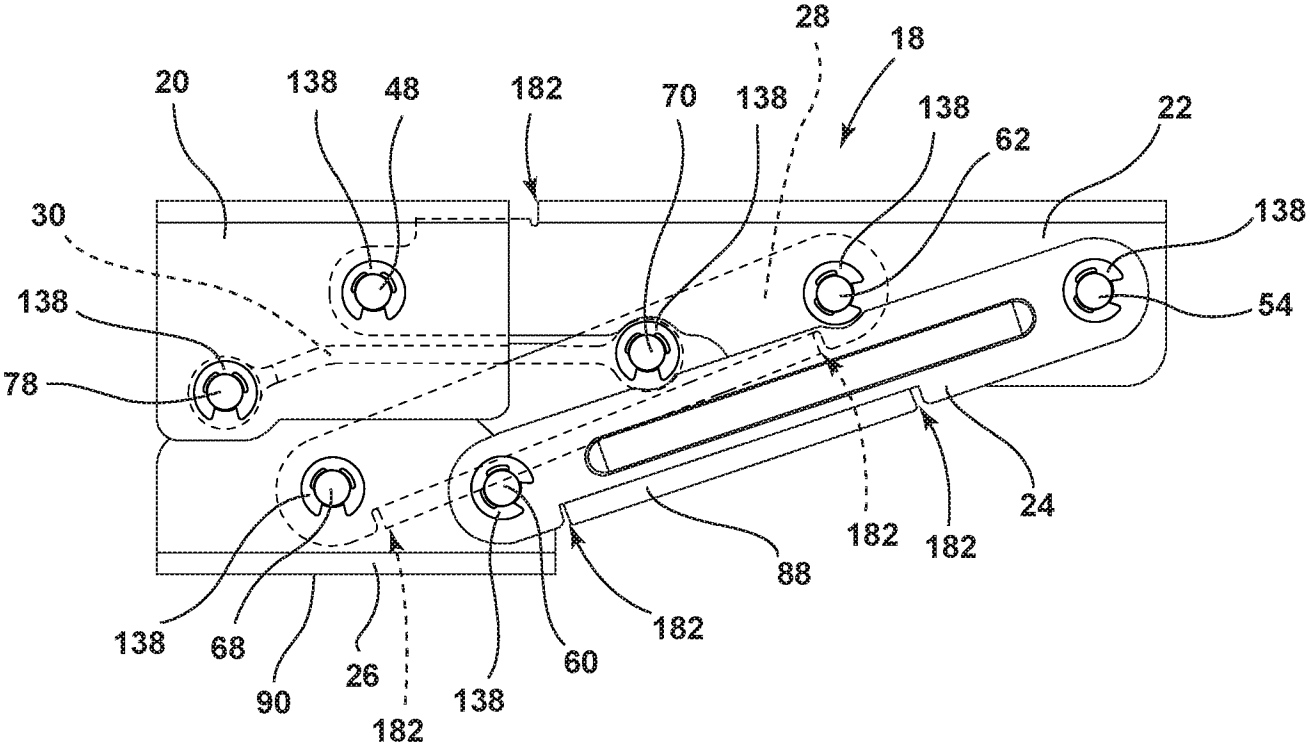
FIG. 13 is a top plan view of the hinge assembly in a contracted position, according to some examples, having at least one link in a vertical orientation.
Figure 14:
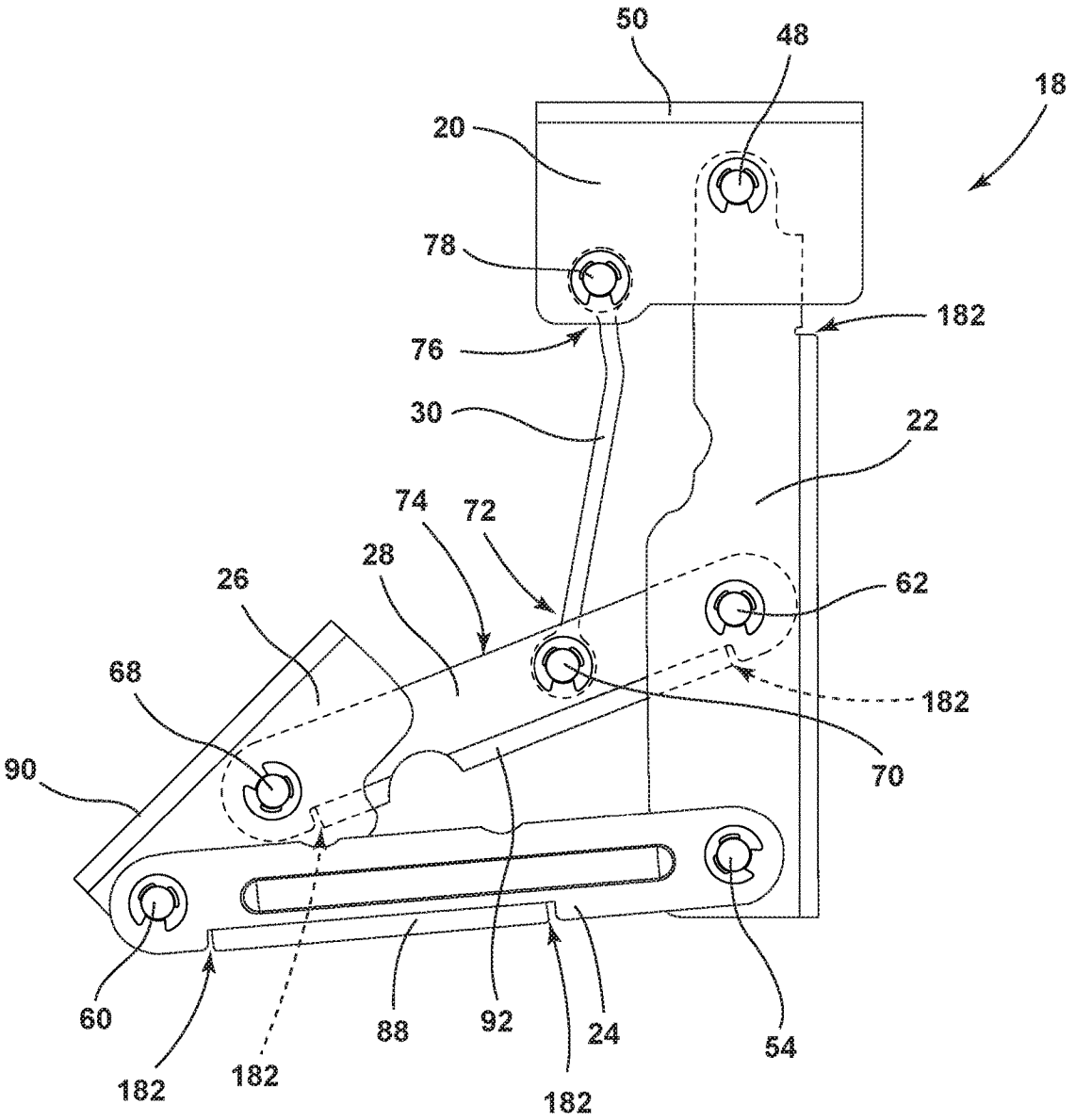
FIG. 14 is a top plan view of the hinge assembly in an expanded position, according to some examples.

Referring still to FIGS. 12-14, some of the links (e.g., the second link 22, the third link 24, and the fifth link 28) may include vertical surfaces 52, 88, 92 that extend less than the full length of the link 22, 24, 28. Accordingly, an indent 182 may be disposed outwardly of each end of the vertical sections. The indent 182 may be cut into the link 22, 24, 28 prior to bending of the vertical surfaces 52, 88, 92.

The third link 24 may include a first end portion 212. The first surface 112 and the second surface 122 may be spaced apart at the end portion to be positioned over and coupled with an end of the fourth link 26. The vertical surface 88 of the third link 24 may extend only partially between the first and second end portions of the third link 24. The vertical surface 88 and the first and second surfaces 112, 122 may define a void 214 configured to at least partially receive the second portion 162 of the second link 22 when the hinge is in the contracted position (FIG. 13). The third link 24 may further define reliefs 86 configured to receive the ends of the pivot rods 106 and the clips 138 of the pivot points 62, 70 when the hinge assembly 18 is in the contracted position (FIG. 13).

Referring still to FIGS. 12-14, the fourth link 26 may include the first surface 114 and the second surface 124 spaced apart to be received between the first surface 112 and the second surface 122 of the third link 24 at the first end portion 212. Each of the first surface 114 and the second surface 124 of the fourth link 26 may include an outer edge 204. In various examples, the outer edge 204 may be angled away from a first edge 216 proximate the third pivot point 60 and toward the fifth link 28 when the hinge assembly 18 is in the contracted position (FIG. 13). When the hinge assembly 18 is in the extended position, the outer edge 204 may be positioned parallel with the vertical surface 90 of the third link 24, as discussed in more detail elsewhere herein.

The fifth link 28 may extend between the second link 22 and the fourth link 26. The first and second surfaces 116, 126 of the fifth link 28 may be spaced apart to be received between the first and second surfaces 114, 124 of the fourth link 26 and the first and second surfaces 112, 122 of the third link 24. The first and second surfaces 116, 126 of the fifth link 28 and the vertical surface 92 of the fifth link 28 may define a receiving space 220. The receiving space 220 may be configured to receive the pivot rod 106 of the pivot point 60 when the hinge assembly 18 is in the contracted position (FIG. 13).

Figure 15:
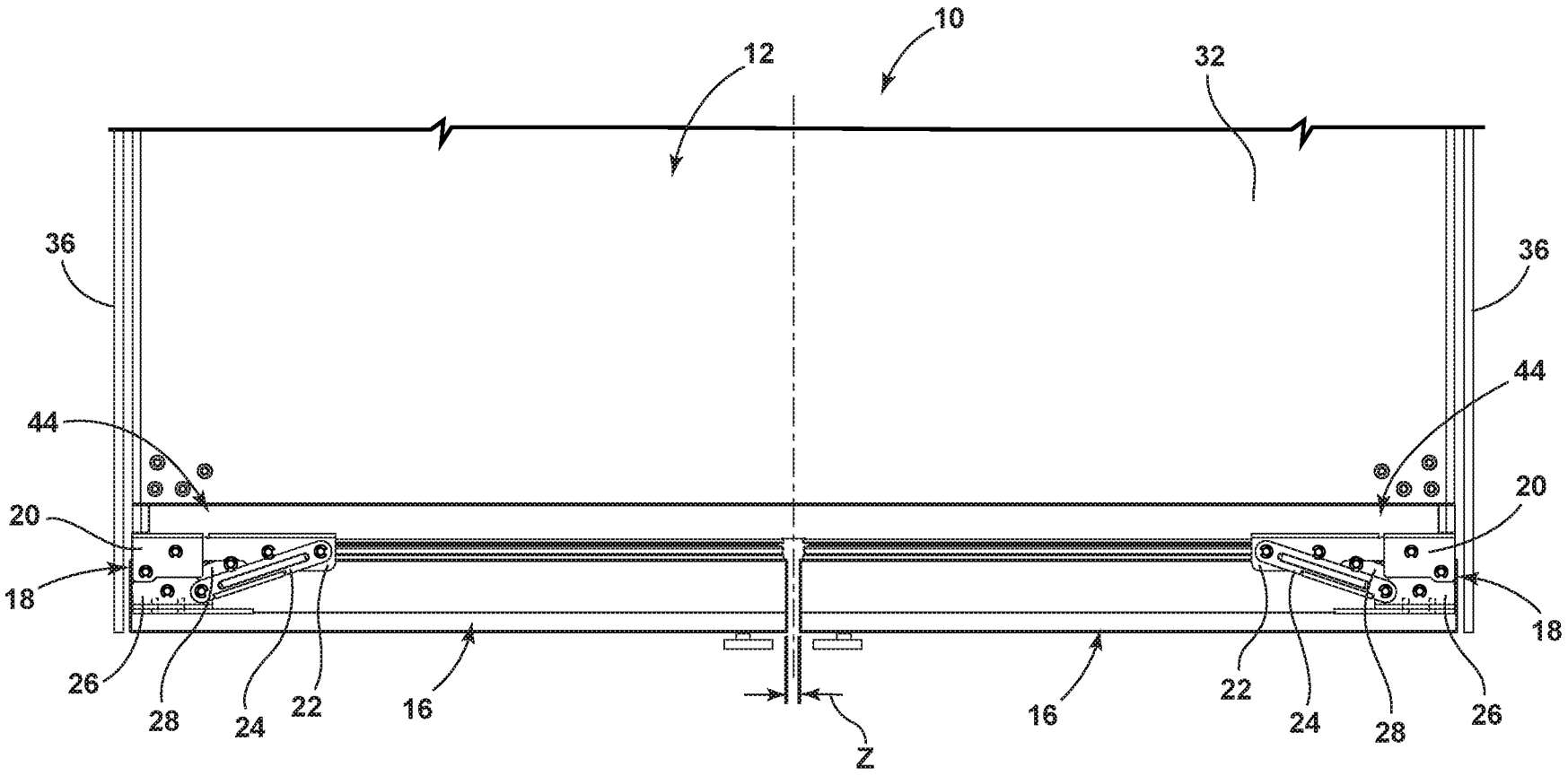
FIG. 15 is a top plan view of the refrigerator having the pair of doors each in a closed position.
Figure 16:
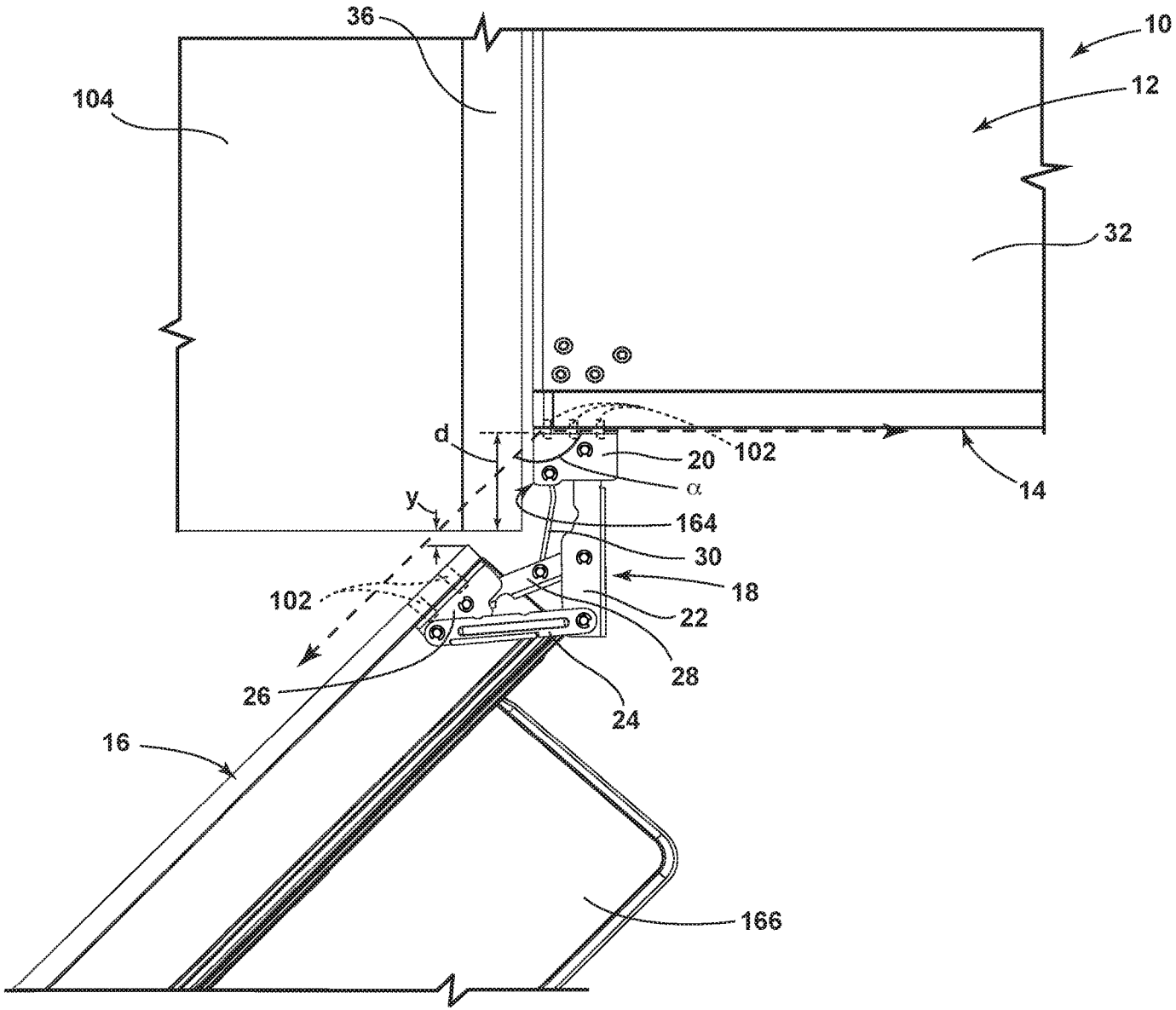
FIG. 16 is a partial top plan view of the refrigerator with the door in an open position, according to some examples.

Referring to FIGS. 15 and 16, as discussed previously, as the door 16 moves from a closed position, as illustrated in FIG. 15, to an open position, as illustrated in FIG. 16, the hinge assembly 18 may rotate and/or translates the door 16 laterally outward of the cabinet 12. Moreover, the sixth link 30, which may have a non-linear orientation, may extend from a position laterally inward of the cabinet 12 to a position laterally outward of the cabinet 12. The sixth link 30 may be connected to a protruding portion 164 of the first link 20 that extends further from the cabinet 12 than the remaining portions of the top surface 108 of the first link 20.

Figure 16A:
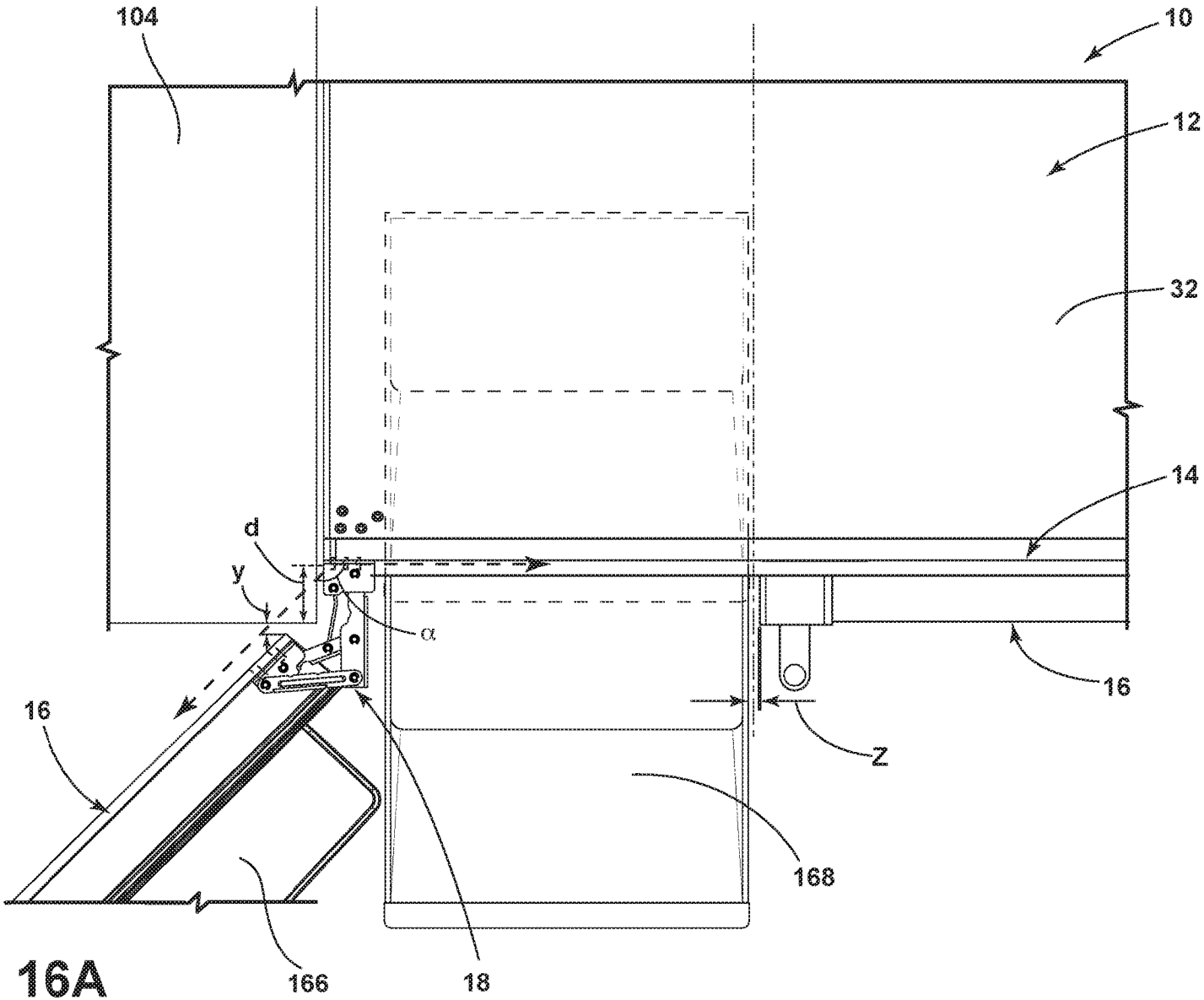
FIG. 16A is a partial top plan view of the refrigerator with the door in an open position and a drawer extended from the refrigerator, according to some examples.

According to various aspects of the device, when the door 16 is in the open position, the door 16 may be positioned at an angle $\alpha$ relative to the cabinet 12. The angle $\alpha$ may be within a range of about 110° to about 150°, about 120° to about 140', about 130° to about 135°, or any value or range of values therein. For example, the angle $\alpha$ may be about 135°. The angle $\alpha$ may be configured to faciliate access to the compartment 14 of the cabinet 12 and removal of components within the compartment 14 without interference from the door 16. Accordingly, a bin 166 may be positioned on the door 16 and may be configured to be received within the cabinet 12 when the door 16 is in the closed position. A storage feature 168 of the refrigerator 10 (e.g., a crisper drawer or pantry drawer) may be a storage bin, a crisper drawer, or a pantry drawer, for example. The storage feature 168 may be removable without contact with the door 16 or the bin 166 of the door 16. The storage feature 168 may also be removable from the compartment 14 of the refrigerator 10 without removing or altering the position of the bin 166 of the door 16. The angle $\alpha$ may further be configured to allow the storage feature 168 of the refrigerator 10 to move between an extended position (see, for example, in FIG. 16A) and a recessed position without abutting the door 16 or the door bin 166 of the door 16. The angle $\alpha$ may further be configured to allow the storage feature 168 of the refrigerator 10 to move between the extended position and the recessed position without requiring removal of the bin 166 of the door 16 or any other component of the refrigerator 10.

Figure 17:
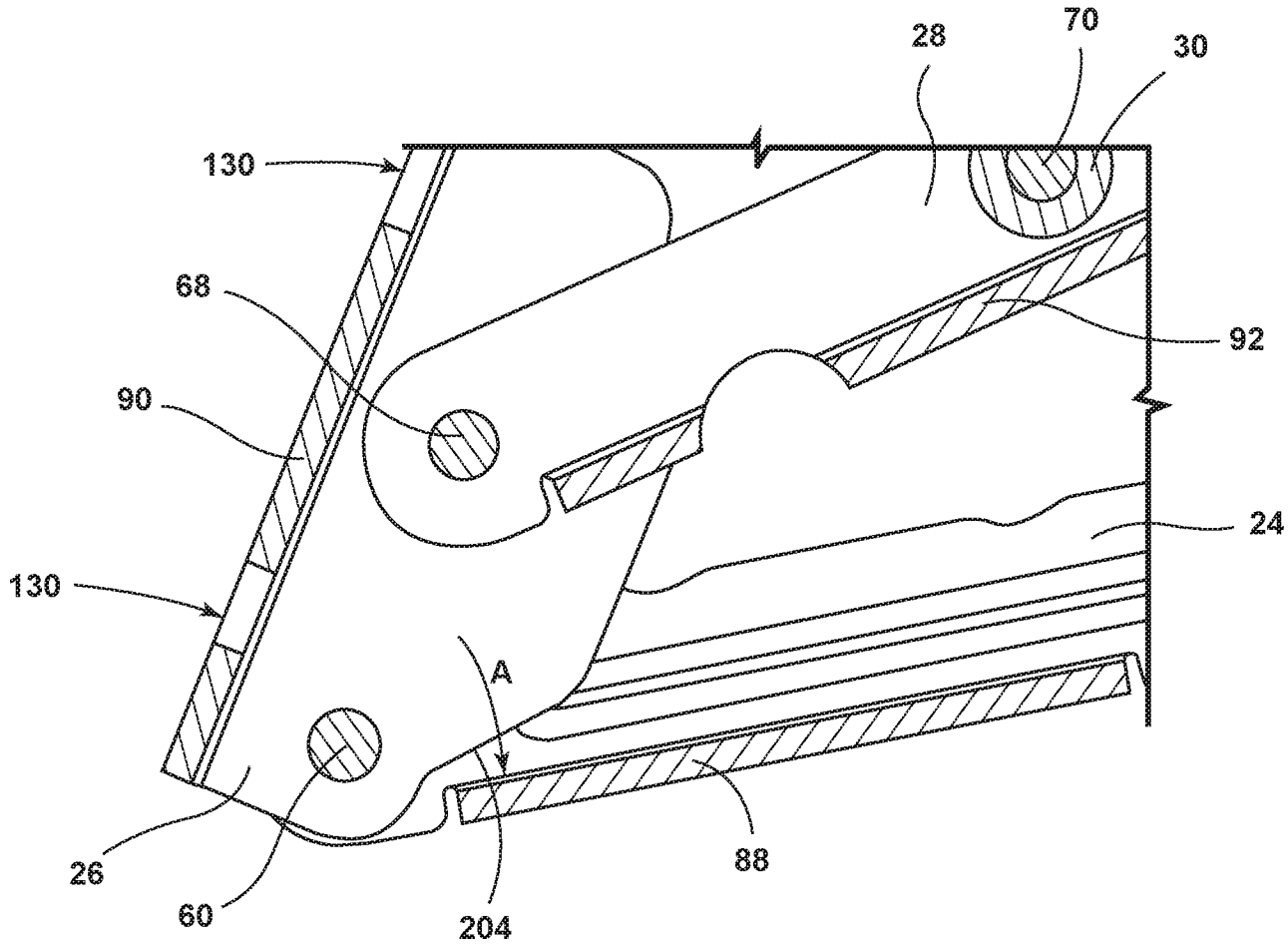
FIG. 17 is a top plan cross-sectional view of a stop of the hinge assembly, according to some examples.
Figure 18:
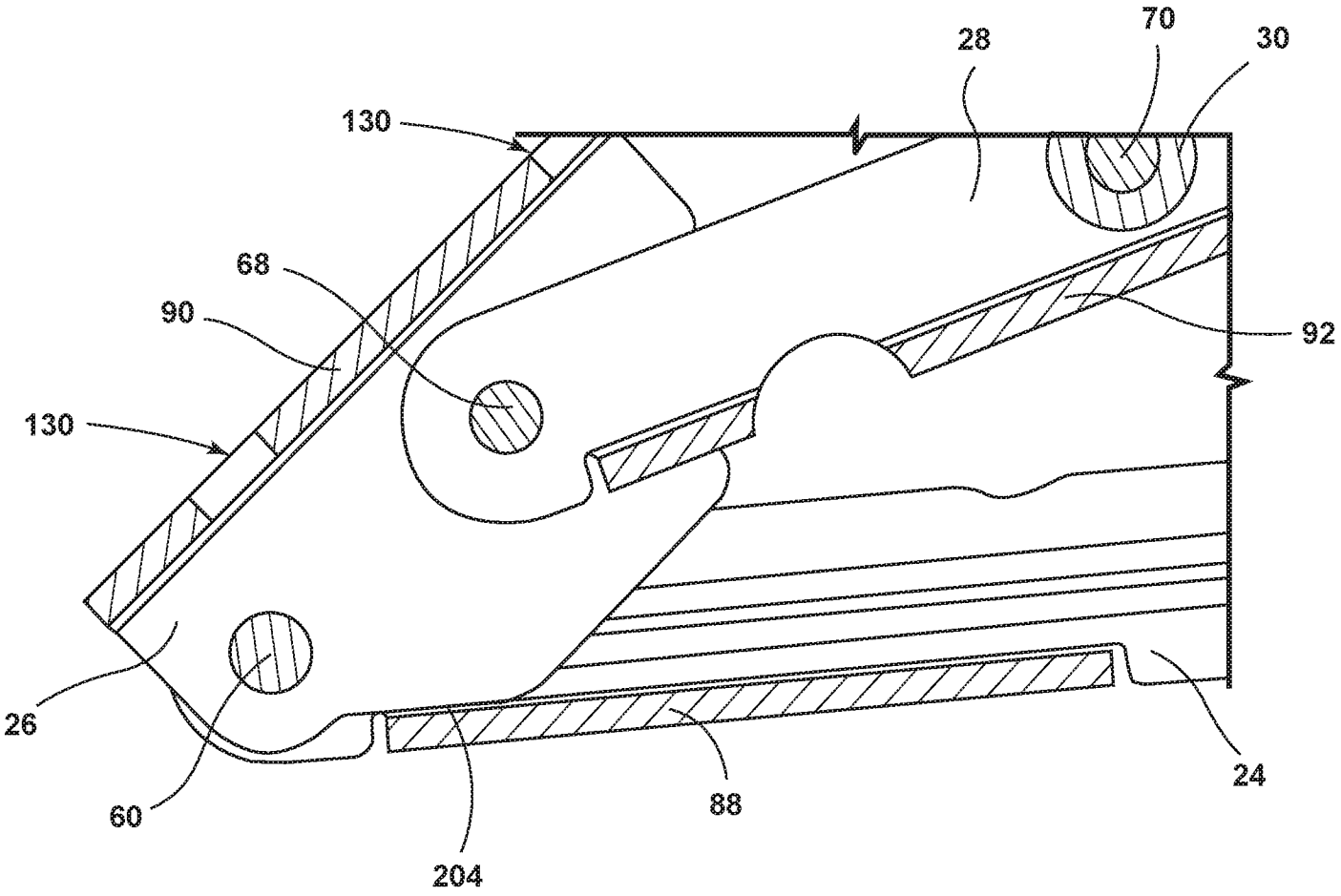
FIG. 18 is a top plan cross-sectional view of a stop engaged with an arm of the hinge assembly, according to some examples.

As shown in FIGS. 16-18, when the door 16 moves from the closed position to the open position, the outer edge 204 of the fourth link 26 is rotated along arrow A toward the vertical surface 88 of the third link 24. When the outer edge 204 of the fourth link 26 contacts the vertical surface 88 of the third link 24, the movement of the door 16 is stopped. The outer edge 204 of the fourth link 26 may be configured to contact the vertical surface 88 of the third link 24 when the door 16 reaches the open position, holding the door 16 at a clearance distance y to prevent contact between the door 16 and the side wall 36. In various examples, the contact between the outer edge 204 and the vertical surface 88 may prevent contact between the door 16 and cabinetry 104 positioned proximate the refrigerator 10.

Referring now to FIGS. 6, 11, 16, and 16A, the hinge assembly 18 may also be configured such that the door 16 may stay within the clearance distance y of the side wall 36 that extends forwardly of the door 16 and/or cabinetry 104 proximate the door 16. The distance y may be within a range of about 2 mm to about 10 mm, about 4 mm to about 8 mm, about 5 mm to about 6 mm, or any value or range of values therebetween. For example, the distance y may be about 3 mm. The door 16 may maintain a clearance distance of less than or equal to 3 mm to prevent an object, such as a finger, from being disposed between the door 16 and the side wall 36 or between the door 16 and the adjacent cabinetry 104.

Referring now to FIGS. 4-6, 10, 15, and 16A, the hinge assembly 18 may further be configured such that each of the doors 16 remain on a respective side of a centerline of the refrigerator 10. The doors 16 may further be spaced apart by a distance z. The distance z may be within a range of about 2 mm to about 10 mm, about 4 mm to about 8 mm, about 5 mm to about 6 mm, or any value or range of values therebetween. For example, the distance z may be about 3 mm. In other examples, the distance z may be about 8 mm. In still other examples, the distance x may be about 9 mm. The distance z spacing apart the doors 16 of the refrigerator 10 also prevents an object, such as a finger, from being disposed between the two doors 16.

Use of the provided disclosure may offer several advantages. For example, by utilizing the disclosed hinge assembly 18, the door 16 may translate and rotate around an adjacently disposed object(s), such as cabinetry 104. This may be advantageous in that it allows the door 16 to be flushly mounted giving the door 16, and/or the appliance, a built-in appearance. Additionally, the use of the hinge assembly 18 provided herein may also assist in preventing objects from being disposed between the door 16 and the cabinet 12 while the door 16 is rotated. It will be understood that this disclosure may be equally applied to appliances other than just the refrigerator 10. For example, the hinge assembly 18 may be used in conjunction with a microwave oven, a conventional oven, cabinetry, commercial and residential doorways, and/or other uses.

According to one aspect, flush-mount refrigerator may be provided. The refrigerator may include a cabinet defining a compartment. The cabinet may be framed by cabinetry. A door may be configured to seal the compartment and may be operable between open and closed positions. The door may be a predetermined distance from the cabinetry when the door is in the open position. A storage feature may be positioned within the compartment and may be movable between an extended position and a recessed position when the door is in the open position. A hinge assembly may be operably coupled to the cabinet and to the door. The hinge assembly may include a first link coupled to the cabinet. A second link may be pivotable about the first link. A third link may be pivotable about the second link. The third link may include a vertical surface. A fourth link may be coupled to the door. The third link may be pivotable about the fourth link. An edge of the fourth link may be configured to contact the vertical surface of the third link when the door is in the open position. A fifth link may be pivotable about the second link and the fourth link. A sixth link may be pivotable about an intermediate portion of the fifth link and the first link. The sixth link may be disposed through a void defined by the fifth link.

According to another aspect, the door may be a first door positioned on a first side of a centerline of the cabinet. A second door may be positioned on a second side of the centerline of the cabinet.

According to other aspects, the first and second doors may be spaced apart by a predetermined spacing. The predetermined spacing may be within a range of about 2 mm to about 10 mm.

According to yet another aspect, the door may be positioned at an angle relative to a front of the cabinet when the door is in the open position. The angle may measure greater than 90 degrees.

According to other aspects, the angle may be within a range of about 130 degrees to about 140 degrees.

According to still other aspects, the predetermined distance may be within a range of about 2 mm to about 5 mm.

According to another aspect, the vertical surface of the third link may be an integral stop for the hinge assembly.

According to yet another aspect, a refrigerator may be provided. The refrigerator may include a cabinet defining a compartment and having at least one side wall. The cabinet may be framed by cabinetry. A first door and a second door may be coupled with the cabinet and may be movable between an open position and closed position. A front surface of each of the first and second doors may be substantially coplanar with a front surface of the cabinetry when each of the first and second doors is in the closed position. Each of the first and second doors may be configured to remain positioned on a respective side of a centerline of the cabinet. A hinge assembly may be coupled to the cabinet and to one of the first and second doors. The hinge assembly may include a six-link mechanism that translates and rotates the respective door forwardly and outwardly of at least one side wall when the respective door is moved from a closed position to the open position. The hinge may be configured to rotate the respective door along until the door is at a predetermined angle relative to a front of the cabinet. The predetermined angle may measure greater than 90 degrees.

According to other aspects, the refrigerator may further include a storage feature positioned within the compartment and movable between an extended position and a recessed position when one of the first and second doors is in the open position.

According to still another aspect, a bin may be positioned on one of the first and second doors. The bin may be positioned outside the range of movement of the storage feature when the respective door is in the open position.

According to yet another aspect, the predetermined angle may be within a range of about 130 degrees to about 140 degrees.

According to still other aspects, the first and second doors may be spaced apart by a predetermined spacing. The predetermined spacing may be within a range of about 2 mm to about 10 mm.

According to another aspect, at least one link of the six-link mechanism may include a vertical surface. Another link of the six-link mechanism may be configured to abut the vertical surface so that the vertical surface is an integral stop for the hinge assembly.

According to still other aspects, each of the first and second doors may be spaced apart from the front surface of the cabinetry by a predetermined distance when each of the first and second doors is in the open position. The predetermined distance may be about 3 mm.

According to yet another aspect, a flush-mount refrigerator may be provided. The refrigerator may include a cabinet defining a compartment and including a pair of side walls that extends forwardly of the compartment. A pair of doors may be coupled to the cabinet and may be positioned on either side of a centerline of the cabinet. The pair of doors may be spaced apart by a predetermined spacing. A storage feature may be positioned within the compartment of the cabinet and may be movable between an extended position and a recessed position when one or both of the pair of doors is in an open position. A hinge assembly may be coupled to the cabinet and to one of the pair of doors. The hinge assembly may include a six-link mechanism that keeps the door within a predefined distance of at least one side wall when the door is moved from a closed position to the open position.

According to other aspects, the predefined distance may be less than 5 mm from the at least one side wall.

According to another aspect, the hinge assembly may include a first link coupled to the cabinet. A second link may be pivotable about the first link. A third link may be pivotable about the second link. The third link may include a vertical surface. A fourth link may be coupled to the door. The third link may be pivotable about the fourth link. An edge of the fourth link may be configured to contact the vertical surface of the third link when the door is in the open position. A fifth link may be pivotable about the second link and the fourth link. A sixth link may be pivotable about an intermediate portion of the fifth link and the first link.

According to still other aspects, the vertical surface of the third link may be an integral stop for the hinge assembly.

According to yet another aspect, the hinge may be configured to rotate the respective door along until the door is at a predetermined angle relative to a front of the cabinet. The predetermined angle may be within a range of about 130 degrees to about 140 degrees.

According to other aspects, the predetermined spacing may be within a range of about 2 mm to about 10 mm.

It will be understood by one having ordinary skill in the art that construction of the described invention and other components is not limited to any specific material. Other exemplary examples of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

Furthermore, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably couplable" to each other to achieve the desired functionality. Some examples of operably couplable include, but are not limited to, physically mateable and/or physically interacting components and/or wirelessly interactable and/or wirelessly interacting components and/or logically interacting and/or logically interactable components.

It is also important to note that the construction and arrangement of the elements of the invention as shown in the exemplary examples is illustrative only. Although only a few examples of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system might be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary examples without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A flush-mounted refrigerator comprising:

a cabinet defining a compartment, the cabinet framed by cabinetry;

a door configured to seal the compartment and operable between open and closed positions, wherein the door is a predetermined distance from the cabinetry when the door is in the open position;

a storage feature positioned within the compartment and movable between an extended position and a recessed position when the door is in the open position; and a hinge assembly operably coupled to the cabinet and to the door, the hinge assembly comprising:

a first link coupled to the cabinet;

a second link pivotable about the first link;

a third link pivotable about the second link, wherein the third link includes a vertical surface extending between first and second horizontal surfaces;

a fourth link coupled to the door, wherein the third link is pivotable about the fourth link, an edge of the fourth link is configured to contact the vertical surface of the third link when the door is in the open position, and the vertical surface of the third link is an interior surface framed by the first and second horizontal surfaces and is an integral stop for the hinge assembly;

a fifth link pivotable about the second link and the fourth link; and a sixth link pivotable about an intermediate portion of the fifth link and the first link, wherein the sixth link is disposed through a void defined by the fifth link.

2. The refrigerator of claim 1, wherein the door is a first door positioned on a first side of a centerline of the cabinet, and further wherein a second door is positioned on a second side of the centerline of the cabinet.

3. The refrigerator of claim 2, wherein the first and second doors are spaced apart by a predetermined spacing, and further wherein the predetermined spacing is within a range of about 2 mm to about 10 mm.

4. The refrigerator of claim 1, wherein the door is positioned at an angle relative to a front of the cabinet when the door is in the open position, the angle measuring greater than 90 degrees.

5. The refrigerator of claim 4, wherein the angle is within a range of about 130 degrees to about 140 degrees.

6. The refrigerator of claim 1, wherein the predetermined distance is within a range of about 2 mm to about 5 mm.

7. The refrigerator of claim 1, wherein the third link is a C-shaped link.

8. A refrigerator comprising:

a cabinet defining a compartment and having at least one side wall, wherein the cabinet is framed by cabinetry;

a first door and a second door coupled with the cabinet and movable between an open position and a closed position, wherein a front surface of each of the first and second doors is substantially coplanar with a front surface of the cabinetry when each of the first and second doors is in the closed position, and further wherein each of the first and second doors are configured to remain positioned on a respective side of a centerline of the cabinet; and a hinge assembly coupled to the cabinet and to one of the first and second doors, wherein:

the hinge assembly includes a six-link mechanism that translates and rotates the respective door forwardly and outwardly of the at least one side wall when the respective door is moved from the closed position to the open position;

the hinge assembly is configured to rotate the respective door along until the door is at a predetermined angle relative to a front of the cabinet, the predetermined angle measuring greater than 90 degrees;

at least one link of the six-link mechanism is a C-shaped link including first and second parallel surfaces extending from opposing ends of a vertical surface; and another link of the six-link mechanism is configured to abut the vertical surface so that the vertical surface is an integral stop for the hinge assembly.

9. The refrigerator of claim 8 further comprising:

a storage feature positioned within the compartment and movable between an extended position and a recessed position when one of the first and second doors is in the open position.

10. The refrigerator of claim 9, wherein a bin is positioned on one of the first and second doors, and further wherein the bin is positioned outside a range of movement of the storage feature when the respective door is in the open position.

11. The refrigerator of claim 8, wherein the predetermined angle is within a range of about 130 degrees to about 140 degrees.

12. The refrigerator of claim 8, wherein the first and second doors are spaced apart by a predetermined spacing, and further wherein the predetermined spacing is within a range of about 2 mm to about 10 mm.

13. The refrigerator of claim 8, wherein each of the first and second doors is spaced apart from the front surface of the cabinetry by a predetermined distance when each of the first and second doors is in the open position, and further wherein the predetermined distance is about 3 mm.

14. A flush-mounted refrigerator comprising:

a cabinet defining a compartment and including a pair of side walls that extends forwardly of the compartment;

a pair of doors coupled to the cabinet and positioned on either side of a centerline of the cabinet, wherein the pair of doors is spaced apart by a predetermined spacing;

a storage feature positioned within the compartment of the cabinet and movable between an extended position and a recessed position when one or both of the pair of doors is in an open position; and a hinge assembly coupled to the cabinet and to one door of the pair of doors, wherein the hinge assembly includes a six-link mechanism that keeps the respective door of the pair of doors within a predefined distance of at least one side wall when the respective door is moved from a closed position to the open position, at least one link of the six-link mechanism including a vertical surface extending between and spacing apart first and second horizontal surfaces, and another link of the six-link mechanism being coupled with the respective door and extending at least partially between the first and second horizontal surfaces to selectively contact the vertical surface so that the vertical surface is an integral stop for the hinge assembly defining the open position of the respective door.

15. The refrigerator of claim 14, wherein the predefined distance is less than 5 mm from the at least one side wall.

16. The refrigerator of claim 14, wherein the hinge assembly comprises:

a first link coupled to the cabinet;

a second link pivotable about the first link;

a third link pivotable about the second link, wherein the third link includes the vertical surface;

a fourth link coupled to the door, wherein the third link is pivotable about the fourth link, and the fourth link is the link configured to contact the vertical surface of the third link when the door is in the open position;

a fifth link pivotable about the second link and the fourth link; and a sixth link pivotable about an intermediate portion of the fifth link and the first link.

17. The refrigerator of claim 16, wherein an edge of the fourth link contacts the vertical surface of the third link in the open position.

18. The refrigerator of claim 14, wherein the hinge assembly is configured to rotate the respective door along until the door is at a predetermined angle relative to a front of the cabinet, and further wherein the predetermined angle is within a range of about 130 degrees to about 140 degrees.

19. The refrigerator of claim 14, wherein the predetermined spacing is within a range of about 2 mm to about 10 mm.

20. The refrigerator of claim 14, wherein the third link is a C-shaped link.

* * * * *